US010617265B2

(12) United States Patent
Manko et al.

(10) Patent No.: US 10,617,265 B2
(45) Date of Patent: Apr. 14, 2020

(54) DEVICES FOR PREVENTING TOWEL SLIPPAGE

(71) Applicant: Simply Innovative LLC, Stewartsville, NJ (US)

(72) Inventors: Teresa Manko, Stewartsville, NJ (US); Mark Manko, Stewartsville, NJ (US); Jordan Robert Long, Cary, NC (US)

(73) Assignee: Simply Innovative LLC, Stewartsville, NJ (US)

( * ) Notice: Subject to any disclaimer, the term of this patent is extended or adjusted under 35 U.S.C. 154(b) by 0 days.

(21) Appl. No.: 15/360,013

(22) Filed: Nov. 23, 2016

(65) Prior Publication Data

US 2017/0156553 A1 Jun. 8, 2017

Related U.S. Application Data

(60) Provisional application No. 62/259,719, filed on Nov. 25, 2015.

(51) Int. Cl.
*A47K 10/04* (2006.01)
*A47K 10/12* (2006.01)

(52) U.S. Cl.
CPC ..... *A47K 10/04* (2013.01); *A47K 10/12* (2013.01)

(58) Field of Classification Search
CPC .... H01F 7/0231; H01F 7/0252; H01F 7/0263; H01F 7/0268; Y10T 16/495; Y10T 24/32; A47K 10/12; A47K 10/04
USPC ..... 211/16, 88.04, 6, DIG. 1; 248/206.5, 248/309.4; 335/302, 303, 306; 206/818; 24/303; D23/304
See application file for complete search history.

(56) References Cited

U.S. PATENT DOCUMENTS 261,817 A * 7/1882 Mallory ..... A47K 10/10 211/16
765,162 A * 7/1904 Bernardi ..... A47K 10/025 211/6
1,587,082 A * 6/1926 Mattern ..... A63B 53/14 16/421

(Continued)

OTHER PUBLICATIONS

International Search Report and Written Opinion dated Oct. 16, 2014, for International Application No. PCT/US2014/038819 filed May 20, 2014.

(Continued)

*Primary Examiner* — Hiwot E Tefera
*Assistant Examiner* — Devin K Barnett
(74) *Attorney, Agent, or Firm* — Cook Alex Ltd.

(57) ABSTRACT

Devices, apparatus and systems for preventing towels from slipping off a towel holder are disclosed. The apparatus, devices and systems may include a surface that provides a frictional interface between the towel and towel holder. Two opposing edges of such a device may each include at least one raised or enlarged attachment formation which, when the device is moved from an unraveled condition to an engaged condition, may be aligned and connected to effectively connect the edges to each other. Such a device may further include a plurality of friction formations configured to face and contact a towel and a plurality of ridges configured to face and contact a towel holder when the device is in an engaged condition, surrounding a towel holder and supporting a towel.

15 Claims, 30 Drawing Sheets

(56) References Cited

U.S. PATENT DOCUMENTS 1,769,326 A * 7/1930 Weis ..... A47K 10/04 211/123
1,788,074 A * 1/1931 Woodruff ..... A47K 10/12 211/106
1,969,958 A * 8/1934 Alder ..... A47K 3/003 16/DIG. 2
2,052,606 A * 9/1936 Comstock ..... A47K 10/04 160/85
2,058,416 A * 10/1936 Comstock ..... A47K 10/04 16/109
2,063,585 A * 12/1936 Comstock ..... A47K 10/04 211/123
2,066,335 A 1/1937 Comstock
2,269,420 A * 1/1942 Anderson ..... A47K 3/003 4/577.1
2,470,811 A * 5/1949 Engleman ..... A47K 10/12 24/339
2,605,030 A * 7/1952 Fischer ..... A47G 25/30 211/123
2,606,667 A * 8/1952 Hornick ..... A47K 10/10 188/69
2,644,954 A * 7/1953 Jumper ..... A47K 3/001 4/576.1
3,102,314 A * 9/1963 Alderfer ..... A41F 1/002 24/303
3,156,977 A * 11/1964 Logan ..... B21C 37/15 211/105.2
3,483,494 A * 12/1969 Cromie ..... H01F 7/0215 128/852
3,529,328 A * 9/1970 Davison ..... A47G 25/485 16/87.2
3,585,101 A * 6/1971 Stratton ..... F16B 11/006 156/219
3,638,284 A 2/1972 Baker
3,670,646 A * 6/1972 Welch, Jr. ..... B41F 27/02 101/389.1
3,953,638 A * 4/1976 Kemp ..... A47K 10/16 428/154
3,973,676 A * 8/1976 Brooks ..... A47G 25/0607 211/88.04
4,026,446 A * 5/1977 Kessler ..... A47G 25/26 223/88
4,197,880 A * 4/1980 Cordia ..... B29C 61/04 138/178
4,249,267 A * 2/1981 Voss ..... A41F 1/002 2/121
4,403,366 A 9/1983 Lucke
4,422,194 A * 12/1983 Viesturs ..... A47C 27/085 5/654
4,466,610 A * 8/1984 Israel ..... A63B 21/0023 482/91
D284,259 S * 6/1986 Oury ..... D8/107
D290,683 S * 7/1987 Dartnall ..... D8/319
4,702,381 A * 10/1987 Carter ..... A47K 10/04 211/105.2
4,729,482 A * 3/1988 Nicholson ..... A47K 10/04 211/105.2
4,826,059 A * 5/1989 Bosch ..... A45C 11/24 206/350
D305,402 S * 1/1990 Novak ..... D6/550
4,895,332 A * 1/1990 Hansen ..... A47K 3/003 248/251
4,934,540 A * 6/1990 Novak ..... A47C 7/62 211/124
4,953,862 A * 9/1990 Uke ..... A63B 60/10 473/206
4,971,210 A * 11/1990 Blumenkranz ..... A47F 7/24 211/105.1
5,261,665 A * 11/1993 Downey ..... A63B 53/14 16/DIG. 12
5,584,213 A * 12/1996 Larson ..... B62K 21/26 74/489
5,593,073 A * 1/1997 Finnegan ..... A44C 5/0007 224/183
5,631,093 A * 5/1997 Perry ..... C21D 1/04 148/101
5,664,520 A * 9/1997 Latimer, III ..... E05C 17/04 16/421
5,682,653 A * 11/1997 Berglof ..... G09F 1/10 224/183
5,760,668 A * 6/1998 Testa ..... B23Q 3/1546 206/350
5,775,756 A * 7/1998 Rozenich ..... A63B 21/0724 16/421
5,795,242 A * 8/1998 Ree ..... A63B 53/14 473/303
5,845,375 A * 12/1998 Miller ..... A41D 13/1161 24/452
6,048,303 A * 4/2000 Porter ..... A61N 2/06 600/15
6,153,277 A * 11/2000 Chang ..... B62J 1/18 16/430
6,186,155 B1 2/2001 Cheek
6,197,397 B1 * 3/2001 Sher ..... C09J 5/08 156/245
6,270,132 B1 * 8/2001 Kretschmer ..... A47G 19/303 294/5
6,530,508 B1 * 3/2003 Devine ..... A45F 5/00 224/183
D486,583 S * 2/2004 Self ..... D25/41.1
6,758,351 B1 * 7/2004 Klingsdal ..... D06F 53/005 211/119.18
6,920,655 B2 7/2005 Mitchell
7,187,261 B2 * 3/2007 Cassar ..... B23Q 3/1546 335/303
7,190,248 B2 * 3/2007 Coleman, Jr. ..... B25B 11/002 206/350
7,232,352 B2 * 6/2007 Splaine ..... B63H 16/04 440/101
7,322,068 B1 1/2008 Kim
7,703,179 B2 * 4/2010 Ferguson ..... A63B 53/14 16/431
7,775,948 B2 * 8/2010 Chen ..... A63B 21/075 482/106
7,797,783 B2 9/2010 Chandler et al.
D630,768 S * 1/2011 Witiak ..... D25/41.1
7,955,683 B1 * 6/2011 Ferrell ..... A47K 10/02 15/209.1
D647,630 S * 10/2011 Seehof ..... D25/41.1
D647,631 S * 10/2011 Seehof ..... D25/41.1
D689,172 S * 9/2013 Portilla ..... D23/304
D700,688 S * 3/2014 Portilla ..... D23/304
8,662,682 B2 * 3/2014 Gorodisher ..... G08B 5/004 359/519
8,680,436 B2 * 3/2014 Schmauder ..... B62J 33/00 219/204
D709,600 S * 7/2014 Portilla ..... D23/304
D712,526 S * 9/2014 Portilla ..... D23/304
8,915,208 B2 * 12/2014 Shanahan ..... G09F 17/00 116/173
D726,891 S * 4/2015 Portilla ..... D23/304
D759,888 S * 6/2016 Seehof ..... D25/41.1
9,402,494 B1 * 8/2016 O'Brien ..... A47F 7/12
D766,407 S * 9/2016 Portilla ..... D23/304
D767,106 S * 9/2016 Portilla ..... D23/304
9,526,309 B2 * 12/2016 Huyke-Phillips ..... D05B 23/00
D779,644 S * 2/2017 Waggoner ..... D23/304
D788,274 S * 5/2017 Portilla ..... D23/304
9,782,030 B1 * 10/2017 Bell ..... A47G 25/1471
2001/0052710 A1 * 12/2001 Witherell ..... A63B 21/072 294/137
2002/0114920 A1 * 8/2002 Scholz ..... B25G 1/10 428/119
2002/0164465 A1 * 11/2002 Curro ..... A47L 1/15 428/198
2002/0178551 A1 * 12/2002 Hsu ..... A41F 1/002 24/303
2003/0005558 A1 * 1/2003 Wong ..... A41F 1/006 24/303

(56) References Cited

U.S. PATENT DOCUMENTS

2004/0224151 A1* 11/2004 Horacek ..... A63B 49/08 428/354
2006/0006969 A1* 1/2006 Cassar ..... B23Q 3/1546 335/306
2006/0162073 A1* 7/2006 Nichols ..... B32B 27/12 5/420
2006/0278355 A1* 12/2006 Boatman ..... B31F 1/07 162/117
2007/0088402 A1* 4/2007 Melvin ..... A61N 1/3785 607/35
2007/0245850 A1* 10/2007 Ramali ..... A47B 95/02 74/551.9
2008/0121598 A1* 5/2008 Brinson ..... A47K 10/04 211/88.04
2008/0277359 A1* 11/2008 St. Martin ..... A47K 10/04 211/16
2008/0283478 A1* 11/2008 Amirault ..... A47K 10/04 211/13.1
2009/0070919 A1* 3/2009 Kim ..... A41F 9/00 2/319
2009/0220731 A1* 9/2009 Manifold ..... D21H 27/00 428/113
2009/0236299 A1* 9/2009 Hall ..... A47K 10/02 211/16
2009/0275448 A1* 11/2009 Fishman ..... A63B 21/072 482/139
2009/0289089 A1* 11/2009 Fullerton ..... H01F 7/0215 224/183
2009/0289090 A1* 11/2009 Fullerton ..... A45F 5/02 224/183
2010/0055221 A1* 3/2010 Hein ..... B29C 33/76 425/3
2010/0120586 A1* 5/2010 Ruschell ..... A63B 1/00 482/38
2010/0136291 A1* 6/2010 Graff ..... B31F 1/07 428/154
2010/0178821 A1* 7/2010 Morris ..... A47K 10/02 442/1
2010/0183814 A1* 7/2010 Rios ..... C09D 183/04 427/387
2011/0017341 A1* 1/2011 Terracino ..... A47G 27/0206 139/383 R
2011/0120188 A1* 5/2011 Kaupp ..... A44C 15/005 63/12
2011/0179605 A1* 7/2011 Slank ..... A41F 1/002 24/306
2011/0308049 A1* 12/2011 Sun ..... B65D 63/1027 24/306
2013/0029106 A1* 1/2013 Lee ..... D21H 27/002 428/172
2014/0076487 A1* 3/2014 Su ..... B25G 1/10 156/245
2014/0259553 A1* 9/2014 Sjoquist ..... A41F 1/002 24/303
2014/0274614 A1* 9/2014 Newman ..... A63B 21/4035 482/139
2015/0234201 A1* 8/2015 Levesque ..... G02C 11/00 351/155
2016/0003269 A1* 1/2016 Russell-Clarke ..... A41F 1/002 24/303
2016/0081519 A1* 3/2016 Manko ..... A47K 10/04 211/16
2017/0020342 A1* 1/2017 Wein ..... A47J 43/25
2017/0127813 A1* 5/2017 Calman ..... A45F 5/021

OTHER PUBLICATIONS

Product Brochure for Vipp Towel Bar dated Sep. 1, 2011, retrieved from the Internet site http://www.dwr.com/product/bath/view-all/vipp-towel-bar.do (1 page).
Product Brochure for No-Slip Dish Towels dated Sep. 1, 2011, retrieved from the Internet site http://www.marthastewart.com/273383/no-slip-dish-towels (1 page).
Product Brochure for No-Slip Dish Towel dated Sep. 1, 2011, retrieved from the Internet site http://fancyfrugallife.blogspot.com/2011/08/no-slip-dish-towel.html (2 pages).
Product Brochure for Silicone Pot Holder with Magnet dated Aug. 31, 2011, retrieved from the Internet site http://www.oxo.com/p-898-silicone-pot-holder-with-magnet.aspx 1 pg.

* cited by examiner

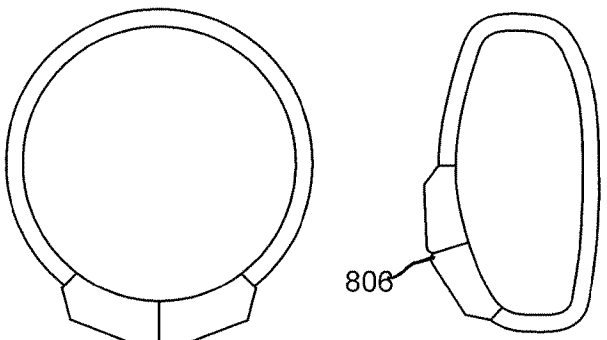
Fig. 30(a)
Fig. 30(b)
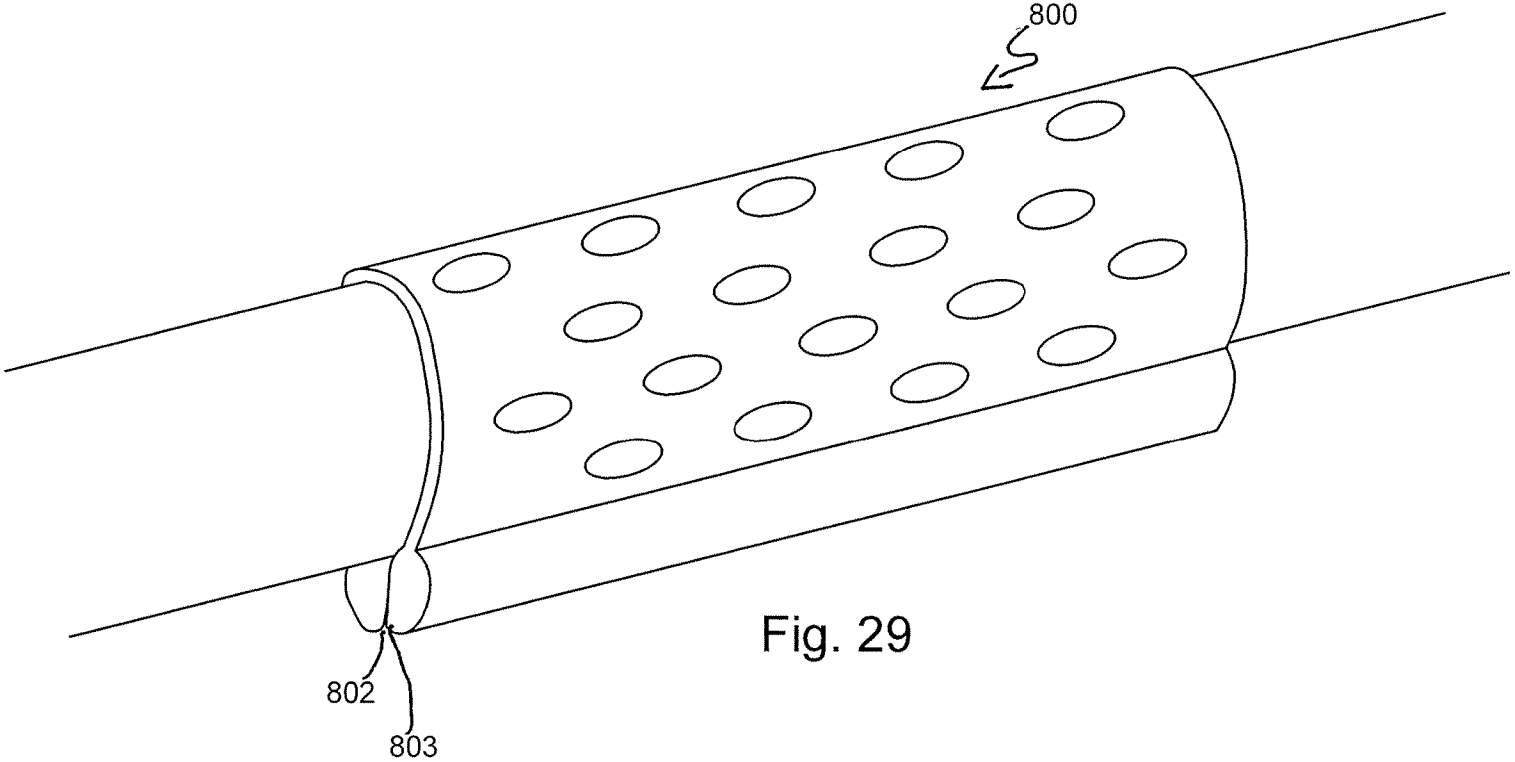
Fig. 29

DEVICES FOR PREVENTING TOWEL SLIPPAGE

CROSS-REFERENCE TO RELATED APPLICATION

This application claims the benefit of and priority to U.S. Patent Application No. 62/259,719, filed Nov. 25, 2015, the contents of which are incorporated herein by reference.

FIELD OF THE DISCLOSURE

The present disclosure is directed to systems, apparatus and/or devices that prevent towels from slipping off a towel holder, appliance handle, or the like. The systems, apparatus and devices may include a surface that provides a frictional interface between the towel and towel holder.

BACKGROUND

It is not uncommon for towels hung on a towel rack or handle of a household appliance, such as an oven or dishwasher, to slip off and fall to the ground. Towels that slip off their holders and fall to the ground are an annoyance for most people, but can also be the source of pain and discomfort to individuals suffering from a physical condition that makes it difficult to regularly bend over and pick up fallen towels. The present inventions described herein address this problem.

SUMMARY

In an aspect, the present disclosure is directed to a device for preventing a towel from slipping off of a towel holder. The device is attachable and removable from the towel holder and includes a towel contacting surface and an opposed towel holder contacting surface. The towel contacting surface of the device provides a frictional interface between the towel and towel holder. More particularly, the towel contacting surface and the towel holder contacting surface may be defined by a flexible, generally planar body with a pair of opposing first and second edges. At least one attachment formation is associated with the body and positioned adjacent to the first edge of the body and at least one attachment formation is associated with the body and positioned adjacent to the second edge of the body. Each attachment element has a greater thickness than the body, and the at least one attachment formation positioned adjacent to the first edge of the body is configured to be aligned with and connected to the at least one attachment formation positioned adjacent to the second edge of the body to place the body into an engaged condition surrounding a towel holder.

BRIEF DESCRIPTION OF THE DRAWINGS

FIG. 10(*b*) is an end view of the embodiment of FIG. 10(*a*);

FIG. 29 is a perspective view of yet another embodiment of a device in accordance with the present disclosure;

FIGS. 30(*a*) and 30(*b*) are end views of the embodiment of FIG. 29 mounted onto towel holders having different shapes;

DETAILED DESCRIPTION OF THE EMBODIMENTS

Figure 1:
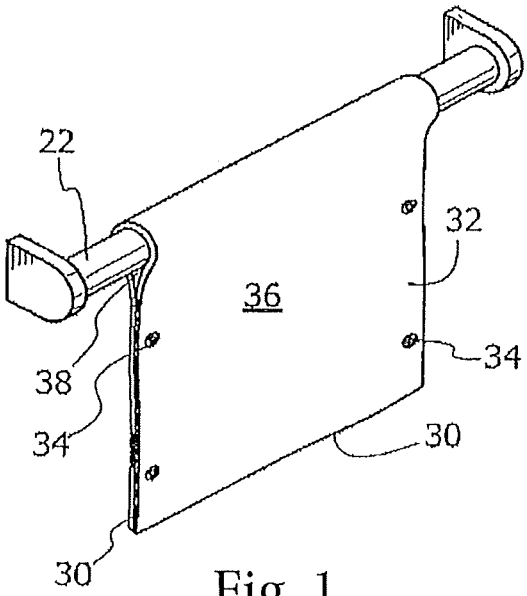
FIG. 1 is a perspective view of one embodiment of a device made in accordance with the present disclosure associated with a towel holder.

As used herein, the term "towel holder" includes, but is not limited to, a towel rod attached to a wall, the handle of an appliance or other unit, such as a drawer or other storage unit. A towel holder may include a rod, either tubular or non-tubular, or other elongated support member, whether located in the kitchen, bathroom, or any other room of a home, business or other facility. Thus, the present disclosure is directed to an apparatus, device or system that at least substantially prevents towels, cloths, rags and other articles made of fabric that may be folded and/or hung over a towel holder from slipping off the same. The device or apparatus may be one that is removably associated with the towel holder.

Turning now to the drawings, FIGS. 1-42 show embodiments of a device for preventing towel slippage. FIGS. 1-42 show devices 30, 200, 300, 400, 500, 600, 700, 800, 900, 912, and 1000 that are usable (and reusable) with and attachable to and removable from towel holders 22. Device 30, 100, 200, 300, 400, 500, 600, 700, 800, 900, 912, and/or 1000 includes a towel contacting surface (e.g., 36 in FIGS. 1 and 3) and a towel holder contacting surface (e.g., 38 in FIGS. 1-3). Towel contacting surface 36 may be smooth in appearance or textured but is preferably made of a material that provides a frictional interface with the towel. As shown, for example, in FIGS. 1-3, device 30 may be a flexible sheet that is, itself, hung over a towel holder 22 in a generally U-shaped profile. Sheet 32 may be made of a suitable material which itself provides the appearance of a smooth (i.e., non-roughened) surface but has a tacky, sticky or other non-slip quality, such as silicone, rubber or other suitable material that can create a frictional interface with towel 100. Other materials which do not have a smooth finish, such as certain foams or fabrics, may also be used. Alternatively, the towel contacting surface 32 may be textured, roughened, dimpled, matte-finished, cross-hatched, with upstanding members extending from a towel contacting surface or be otherwise patterned to provide the necessary friction to substantially prevent towel slippage. When used with or near kitchen appliances that generate heat, the material used for the device is preferably heat resistant and capable of withstanding temperatures typically encountered at the handle of an oven such as, for example, up to about 100° F., 200° F., 300° F., 400° F. and up to 500° F. without causing deformation, melting of the device, or the release of odors. Device 30, 100, 200, 300, 400, 500, 600, 700, 800, 900, 912, and/or 1000 may be made of a flexible material such as, but not limited to silicone or other polymer, including silicone rubber or other elastomer. Device 30, 100, 200, 300, 400, 500, 600, 700, 800, 900, 912, and/or 1000 may be molded. In addition to being heat resistant, the device is preferably waterproof.

Figure 2:
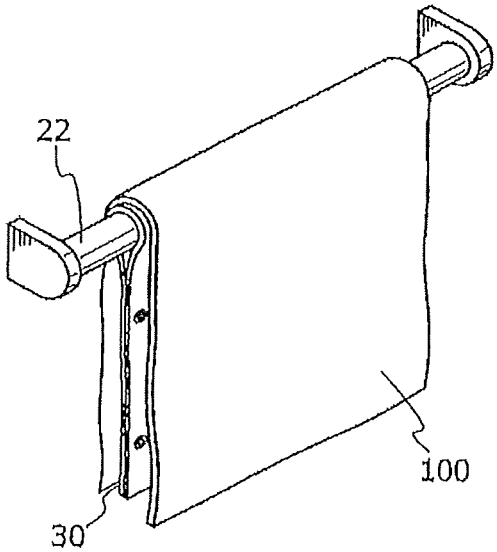
FIG. 2 is a towel holder and a device of FIG. 1 with a towel hung over the device.
Figure 3:
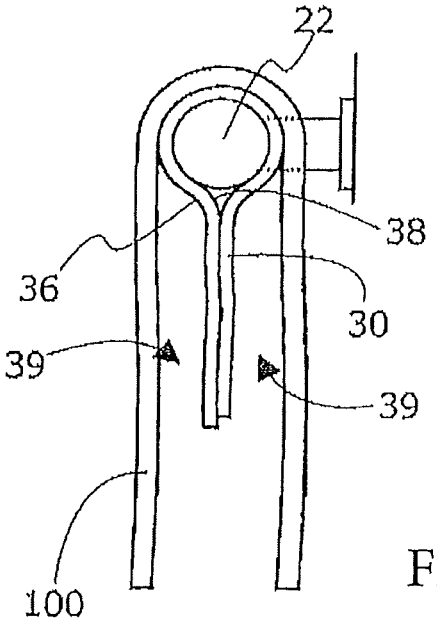
FIG. 3 is a side view of an embodiment of a device in accordance with the present disclosure with a towel.
Figure 4:
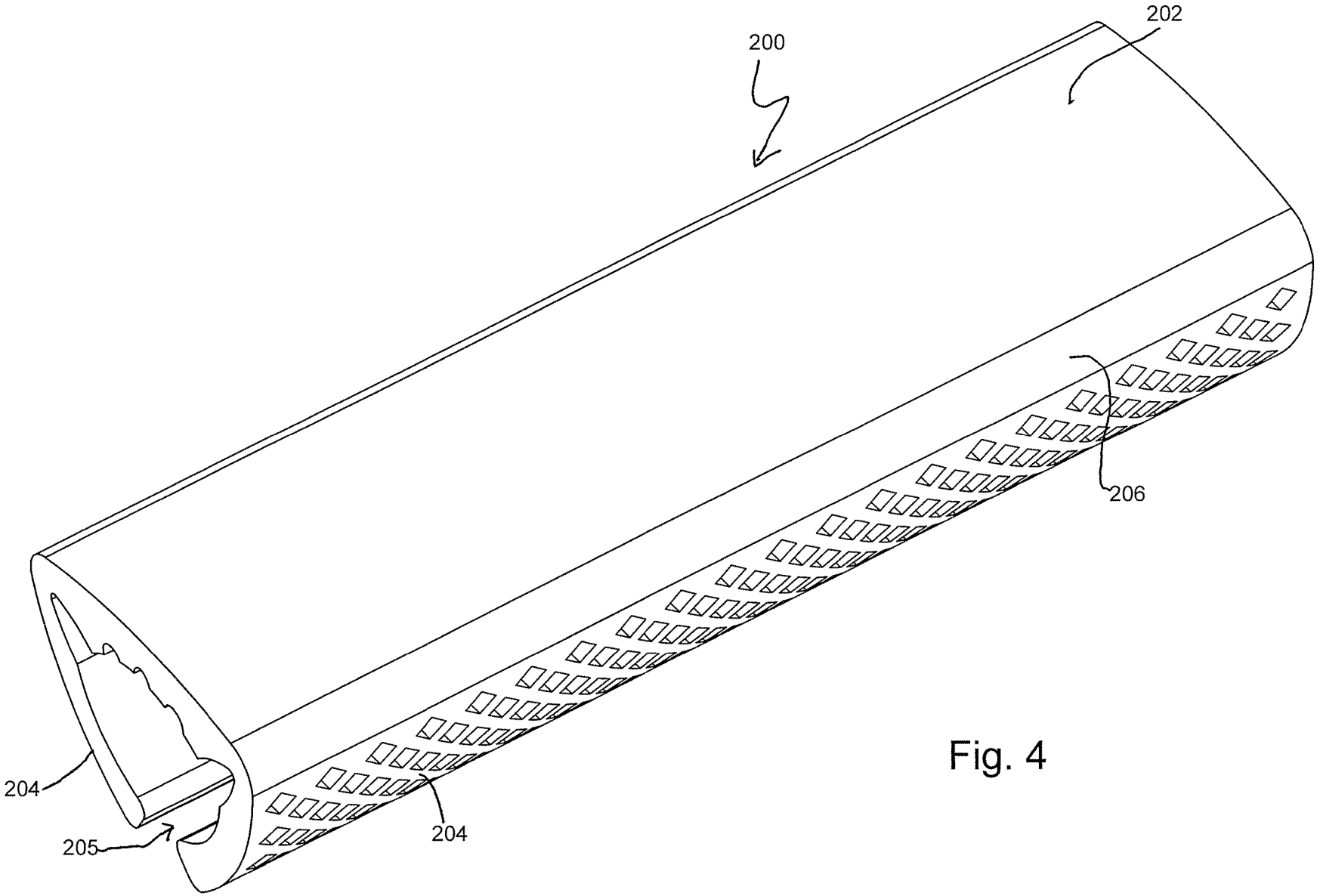
FIG. 4 is a perspective view of another embodiment of a device made in accordance with the present disclosure.
Figure 5A:
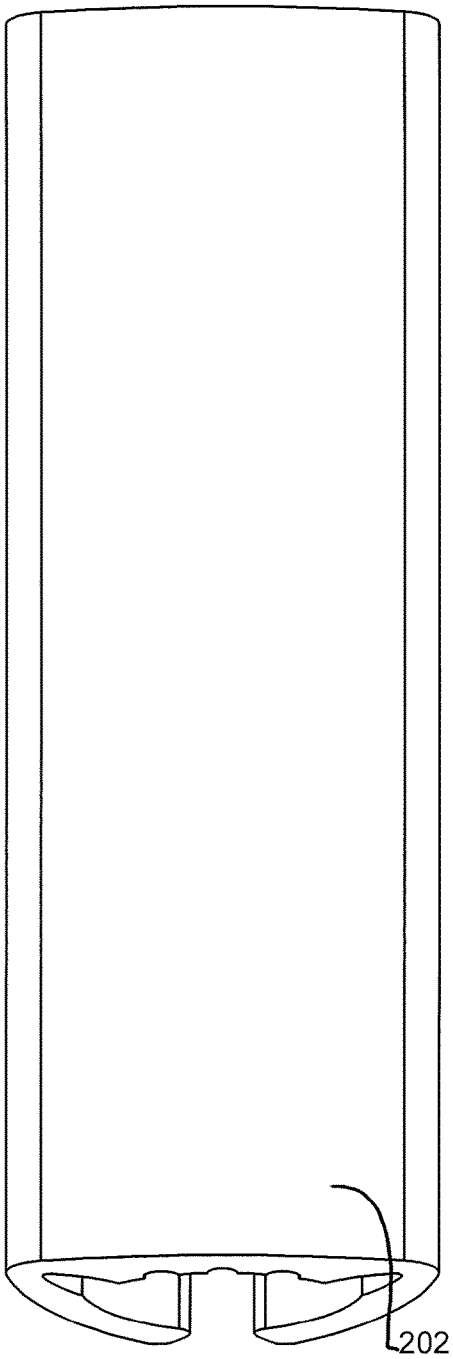
FIGS. 5(*a*) and 5(*b*) are top and bottom views, respectively, of the embodiment of FIG. 4.
Figure 5B:
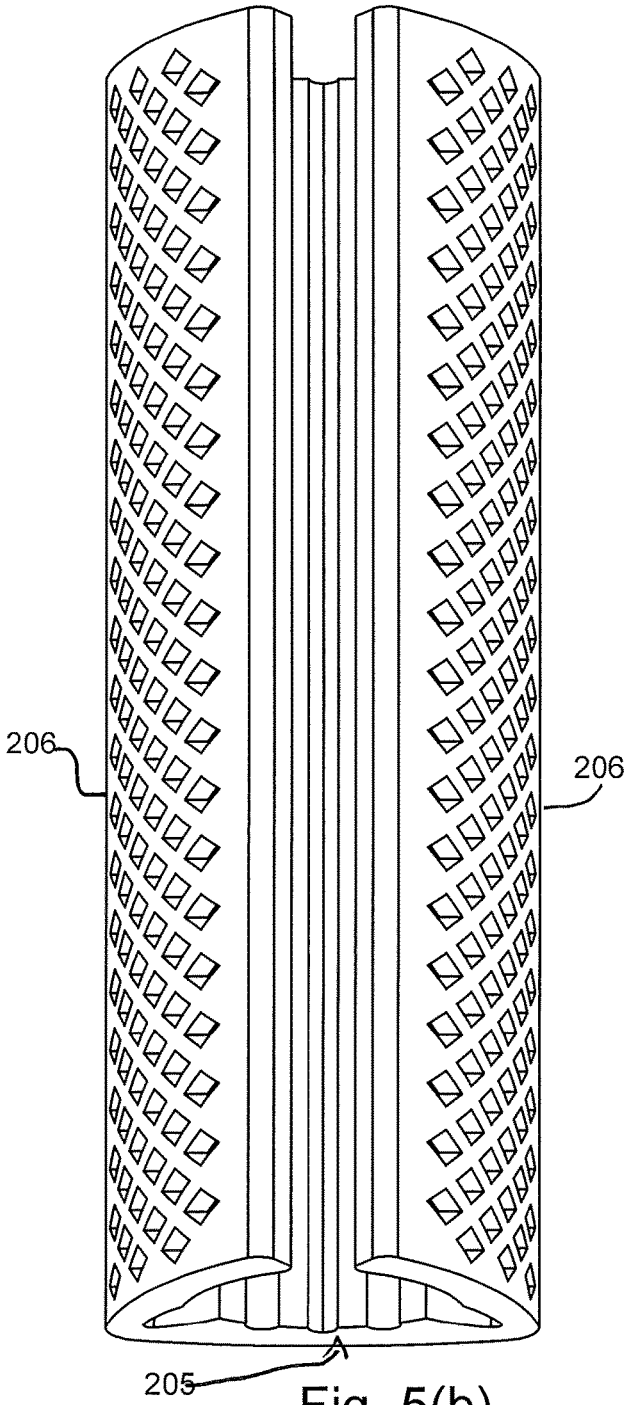

As further shown in FIGS. 1-3 and noted above, device 30 may be hung in a U-shape over towel holder 22. Opposing plies or portions of towel holder contacting surface 38 of device 30 may be fastened together, as shown in FIGS. 1-3, in any one or more of several ways. For example, as shown in FIGS. 1-2, facing plies or portions may be held together using easy-to-open fasteners 34. Alternatively, facing plies or portions of surface 38 may be held together by other types of commonly used fastening means, such as Velcro® tabs or strips, magnets, tapes and the like. In a further alternative, at least one portion of towel holder contacting surface 38 may itself have a tacky or sticky and/or self-adhesive quality, at least on that portion that is intended to hang below towel holder 22. This allows plies to remain in contact without the need for separate fasteners. For example, at least a portion of towel holder contacting surface 38 may have an adhesive applied thereon in an amount and of a type that allows for (1) repeated adhesion of the facing portions of towel holder contacting surface 38 and (2) easy peeling apart of the facing portions when the device is removed from towel holder 22. Of course, in another embodiment, opposing plies need not be fastened or held together at all, and may simply hang freely from the towel holder 22. However, it may be preferable that the plies be held together below holder 22, leaving a gap or space 39 between device 30 and towel 100. By attaching opposing plies or portions of the device 30 together and leaving a gap or space 39 between device 30 and the towel 100, the user will be less likely to grab both device 30 and towel 100.

The device in accordance with the present disclosure may have a length that is substantially coincident with the length of a standard kitchen or bathroom cloth or towel or even slightly longer than the length of the towel. Alternatively, device 30 may be shorter in length than the standard cloth or towel, as shown in FIG. 3, such that the user can easily grab an end of the towel 100 without also inadvertently grabbing device 30. Towel 10 may then be hung over device 30.

In alternative embodiments, as described below, rather than attaching opposing plies to each other, the device may be shorter with ends configured to cooperatively attach to each other and thereby secure the device relative to the towel holder. In a further embodiment, the device may be a sheet or strip that is successively wrapped over the towel holder and, optionally, over itself. As noted, such embodiments of the device made in accordance with the present disclosure are shown in FIGS. 4-36 and described below.

Figure 6:
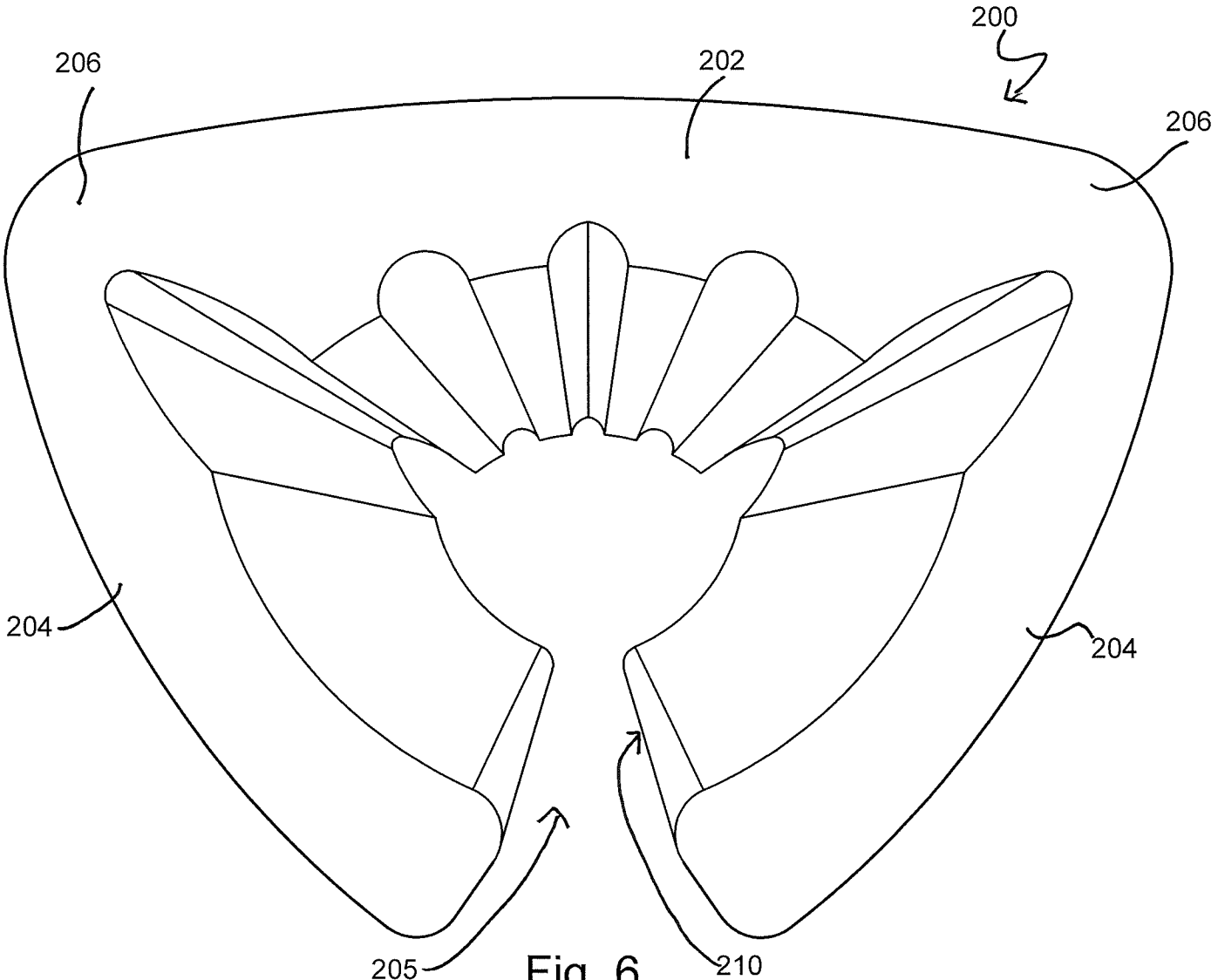
FIG. 6 is an end view of the embodiment of FIG. 4.
Figure 7:
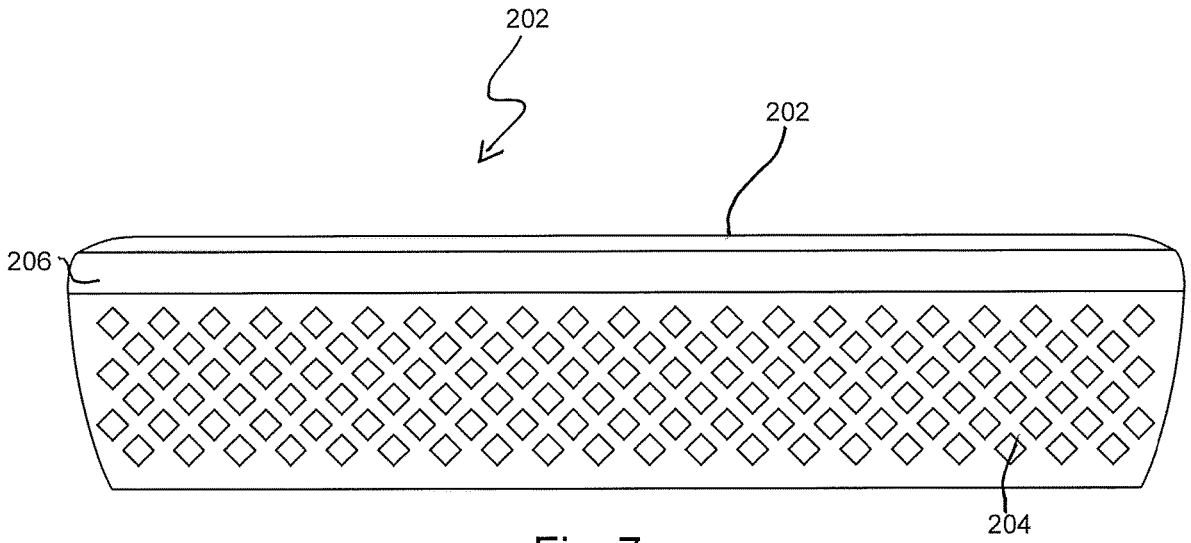
FIG. 7 is a first side view of the embodiment of FIG. 4.
Figure 8:
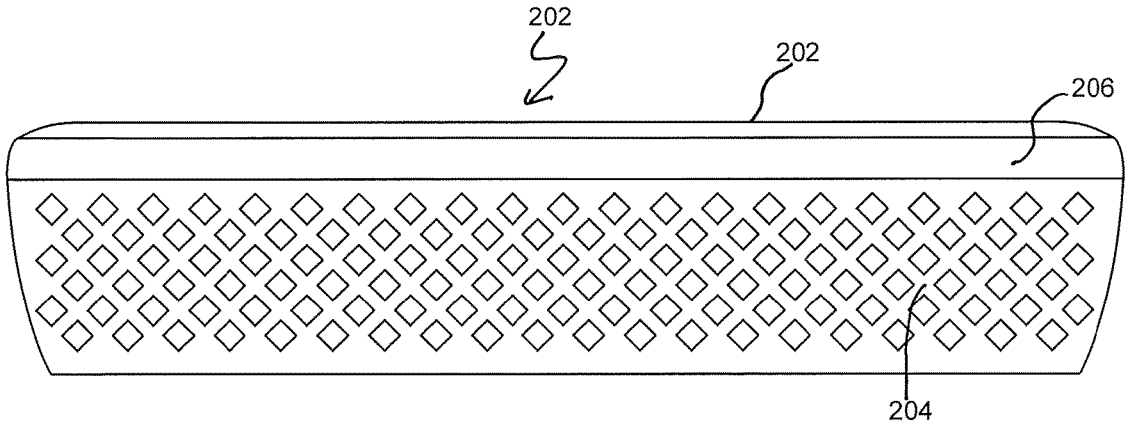
FIG. 8 is another side view of the embodiment of FIG. 4.
Figure 9:
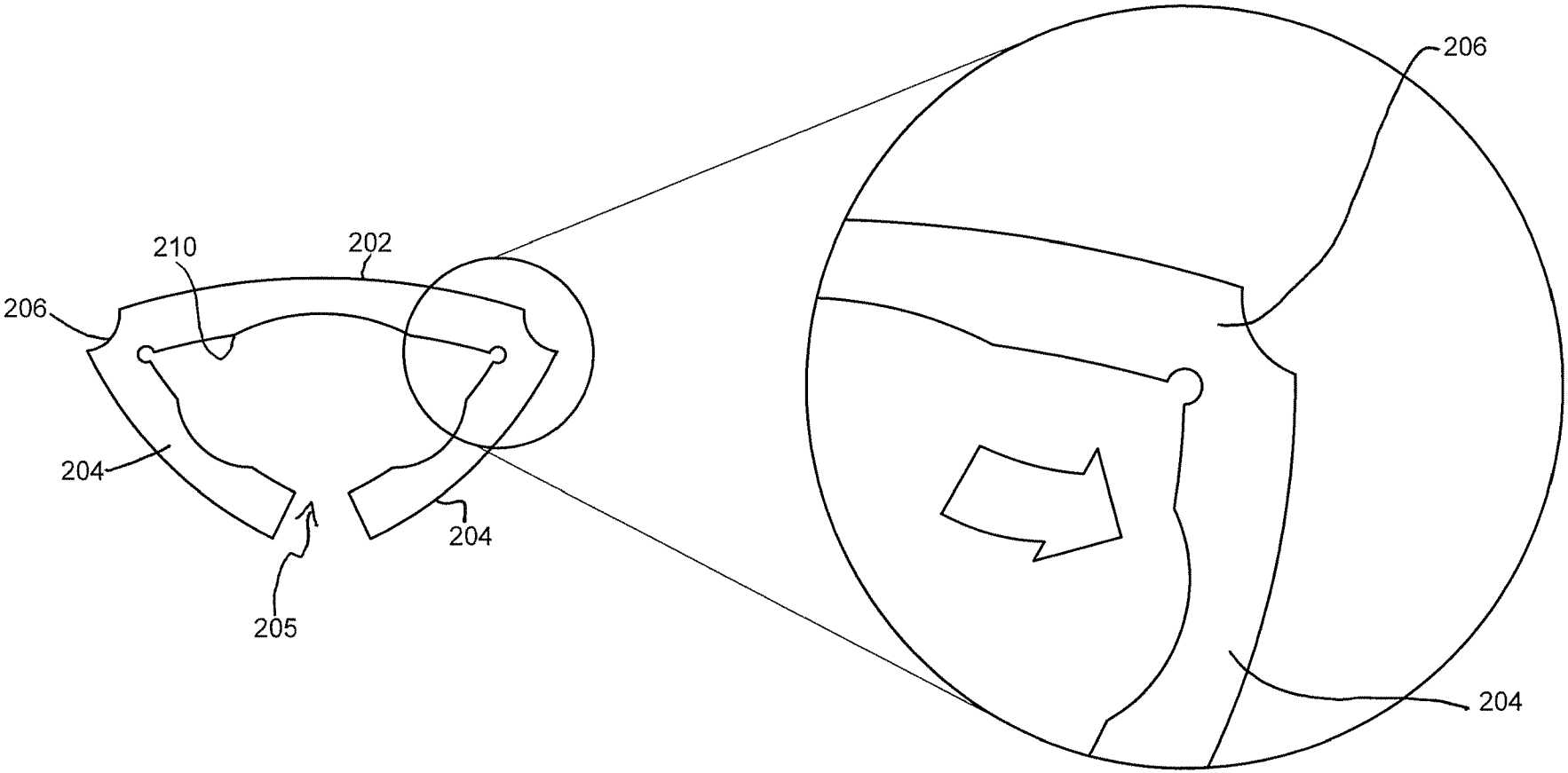
FIG. 9 is a partial perspective view of the embodiment of FIG. 4 depicting hinged movement of lateral arms.

For example, as shown in FIGS. 4-8, a device 200 includes a top portion 202 and side arms 204. Together, side arms and top portion define a gap 205 sized to receive or substantially surround a towel holder. Side arms 204 may be adapted for hinged movement relative to top portion 202. In one particular embodiment, device 200 may include one or more portions that act(s) as a living hinge(s) 206, allowing lateral movement of side arms 204, as shown, for example, in FIG. 9 to apply or remove device 200 to and from towel holder 22. Side arms 204, as well as a top surface of top portion 202 may be textured or contoured, as described above, to provide a frictional surface that will assist in maintaining a towel on the device and keep it from slipping off device 200. The inner surface 210 of device 200 may likewise be contoured or ridged, or otherwise provide an uneven surface that can help grasp a towel holder and keep device 200 firmly in place, as shown in FIG. 6. Device 200 may be made of any polymeric or plastic material, particularly one that can provide a living hinge 206, as shown in the drawings and described above. In one embodiment, the material for device 200 may be silicone and may be molded.

Figure 10B:
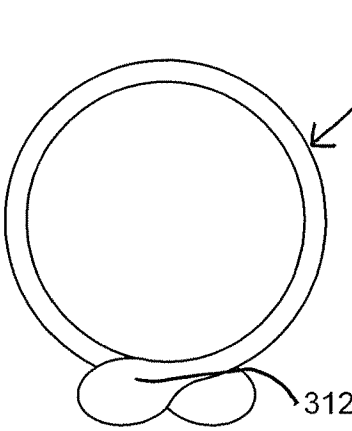
FIG. 10(*a*) is a perspective view of another embodiment of a device made in accordance with the present disclosure.
Figure 10A:
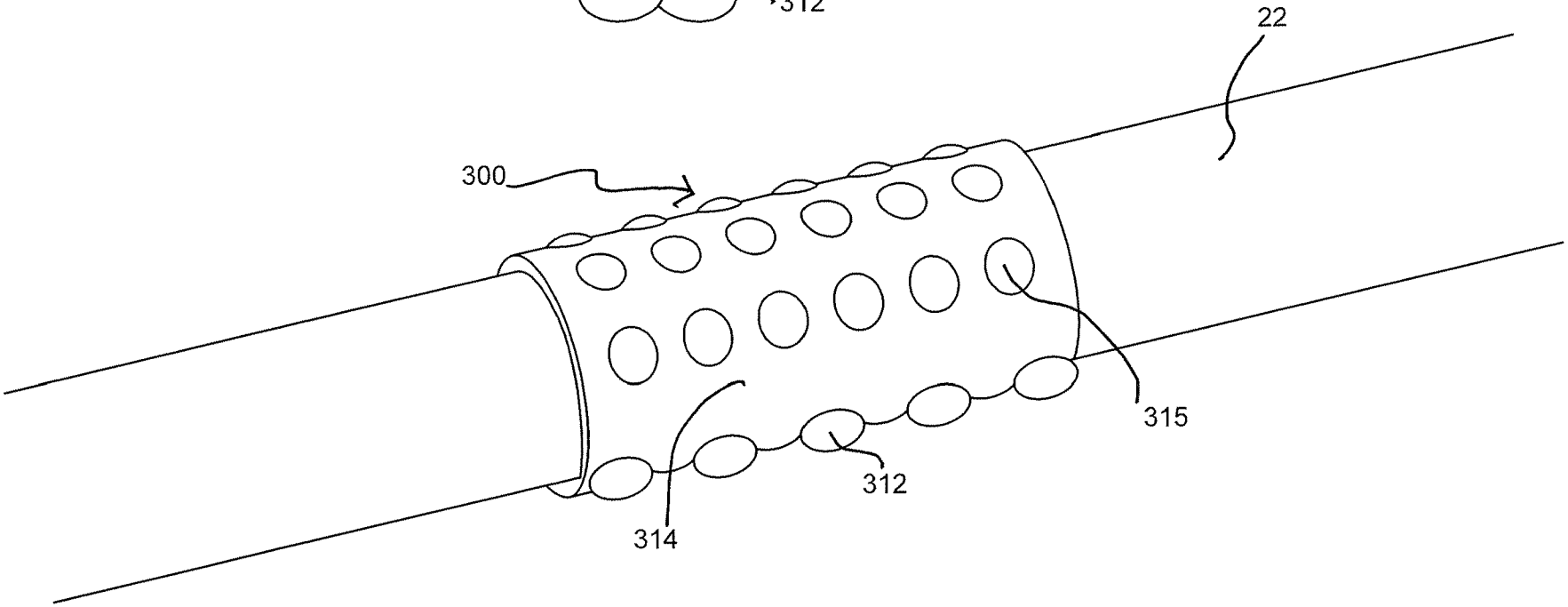
Figure 11:
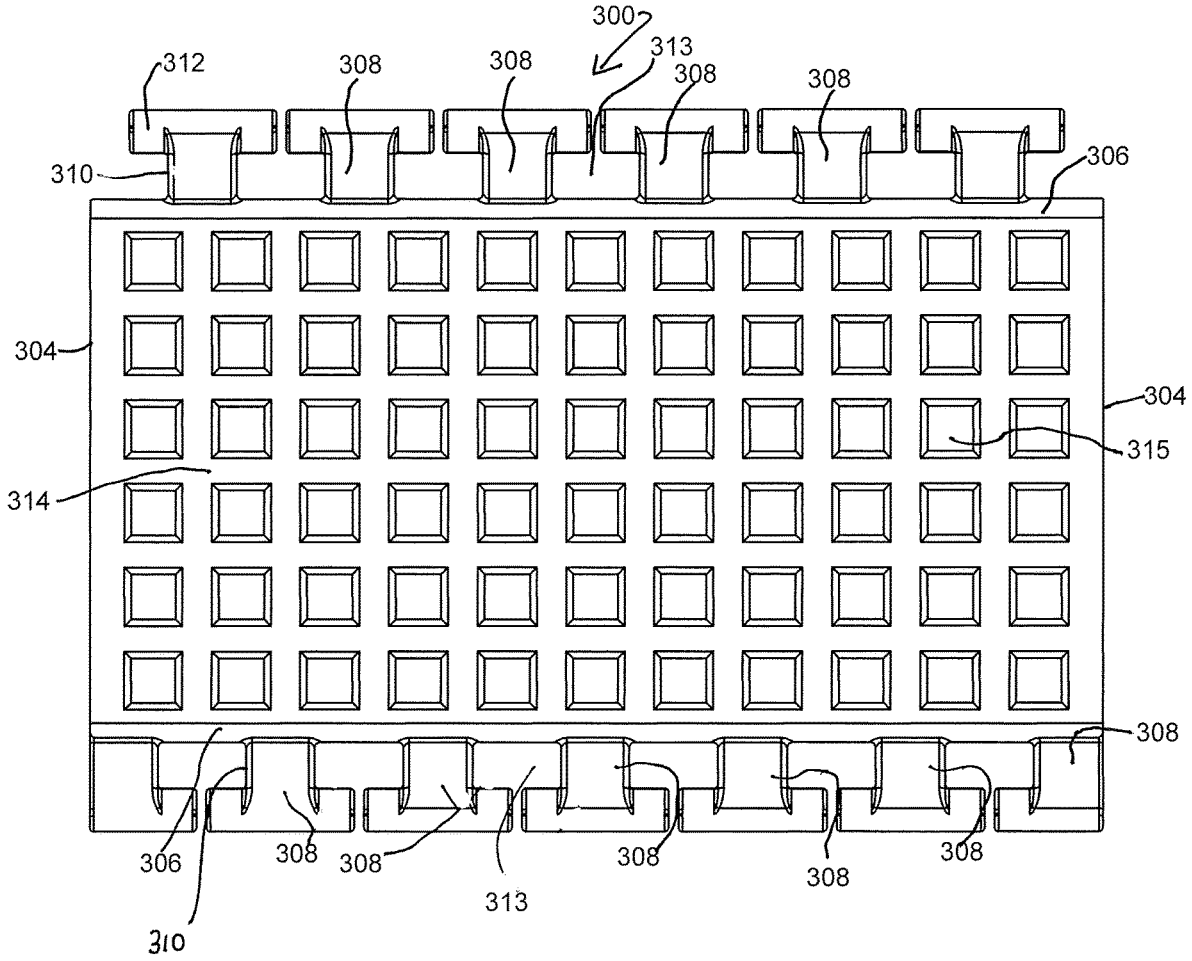
FIG. 11 is a top view of a variation of the embodiment of FIG. 10(*a*) in an unraveled and disengaged condition.

Turning now to FIGS. 10(*a*) and 10(*b*), device 300 represents another embodiment of a towel holding device, in accordance with the present disclosure. Device 300 may take on a cylindrical shape when mounted, but may be provided as a sheet that can be wrapped around towel holder 22. In addition to being adapted for wrapping, device 300 may be made of resilient material having a sufficient degree of elasticity such that it can be stretched, if necessary, and used with towel holders of different diameters and different shapes. As shown in FIGS. 10(*a*) and 10(*b*), as well as FIG. 11, device 300, in its unapplied and unraveled condition may be substantially rectangular, having ends 304 and sides 306. Either ends 304 or sides 306 may include members for engagement with the opposed respective ends or sides. For example, as shown in FIG. 11, device 300 may be rectangularly shaped with fingers 308 extending from each of sides 306. Fingers 308 may include an elongated (neck) portion 310 terminating in a tab or ball shaped portions 312. Fingers 308 with tabs or ball portions may be press fit or snapped through corresponding spaces 313 between fingers on the opposed side 306, thereby resulting in an interengagement which keeps device 300 firmly in place on towel holder 22, yet is easy to disengage, as necessary. Interengagement of fingers 308 is also shown in FIGS. 10(*b*), 12, 13, and 14.

Figure 12:
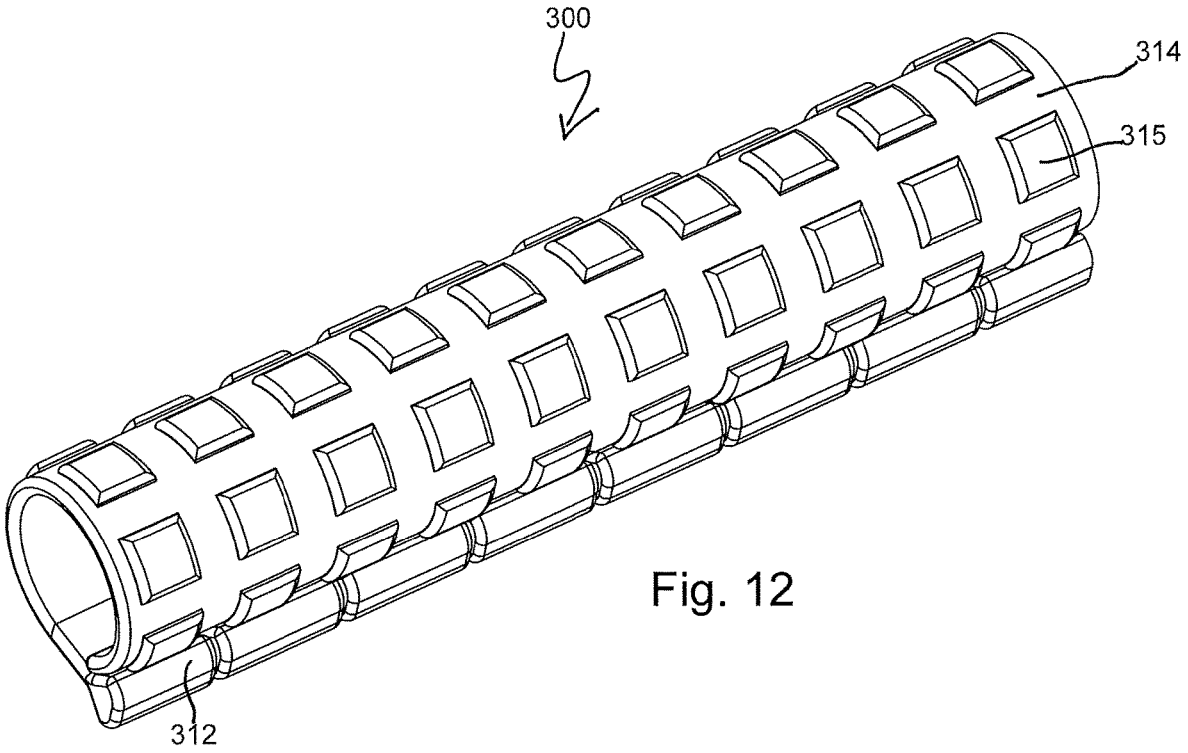
FIG. 12 is a perspective view of the embodiment of FIG. 11 in its engaged condition.
Figure 13A:
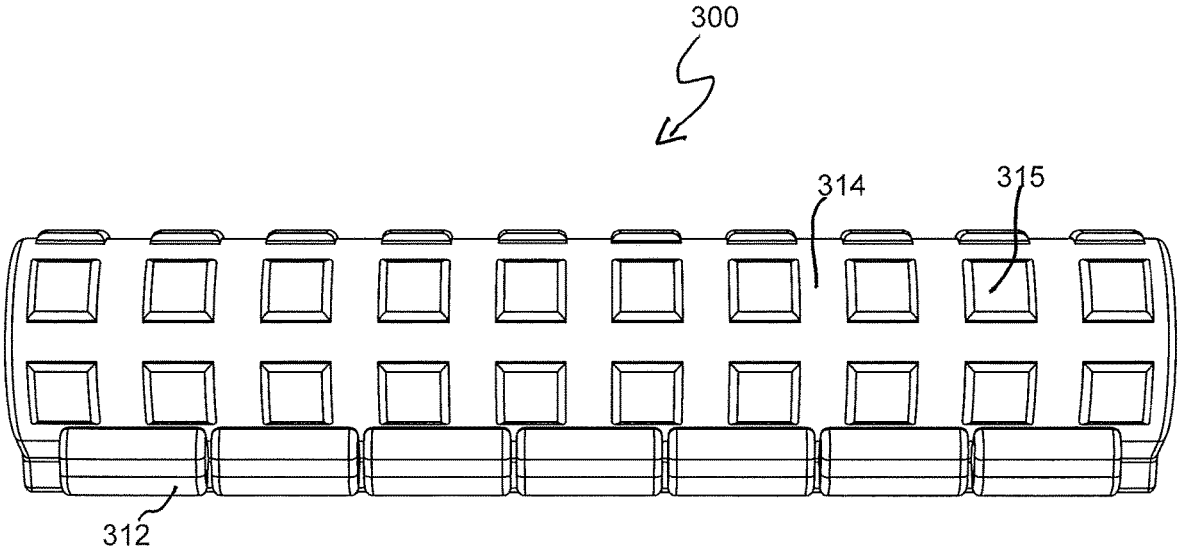
FIGS. 13(*a*) and 13(*b*) are first and second side views of the embodiment of FIG. 11.
Figure 13B:
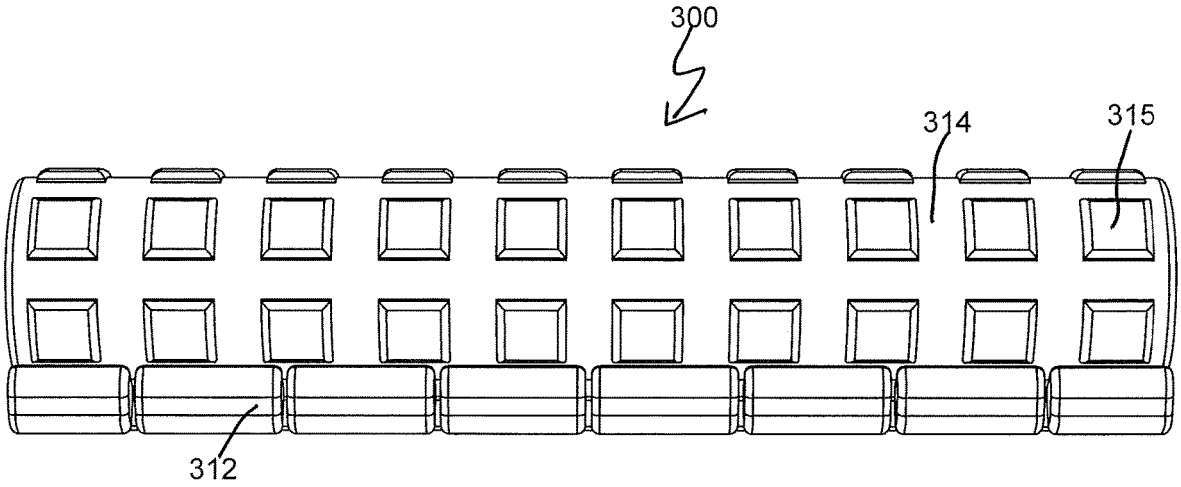
Figure 14:
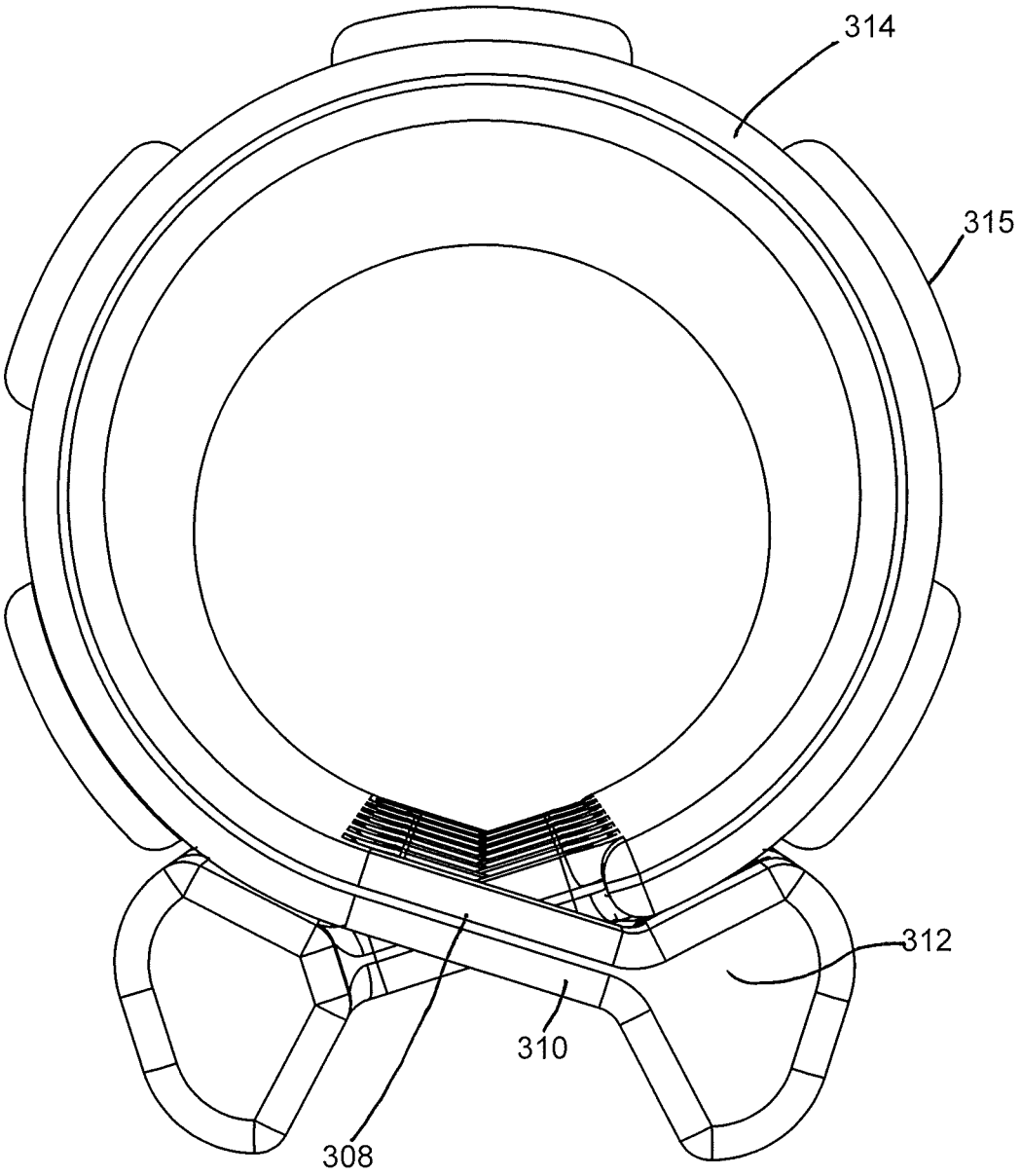
FIG. 14 is an end view of the embodiment of FIG. 11.
Figure 15A:
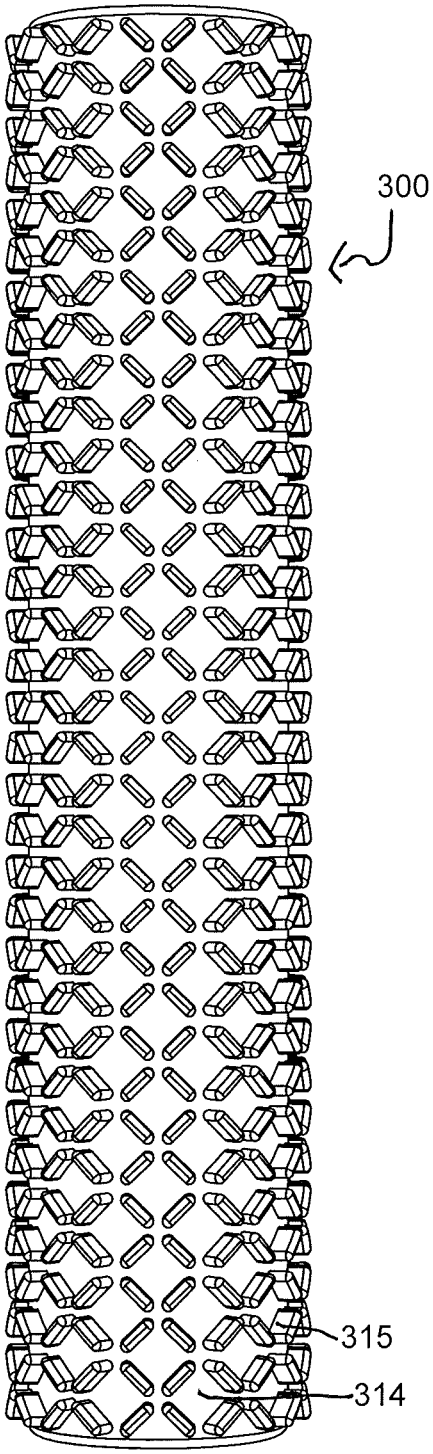
FIGS. 15(*a*) and 15(*b*) are top and bottom plan views, respectively, of a further variation of the embodiment of FIG. 10(*a*)
Figure 15B:
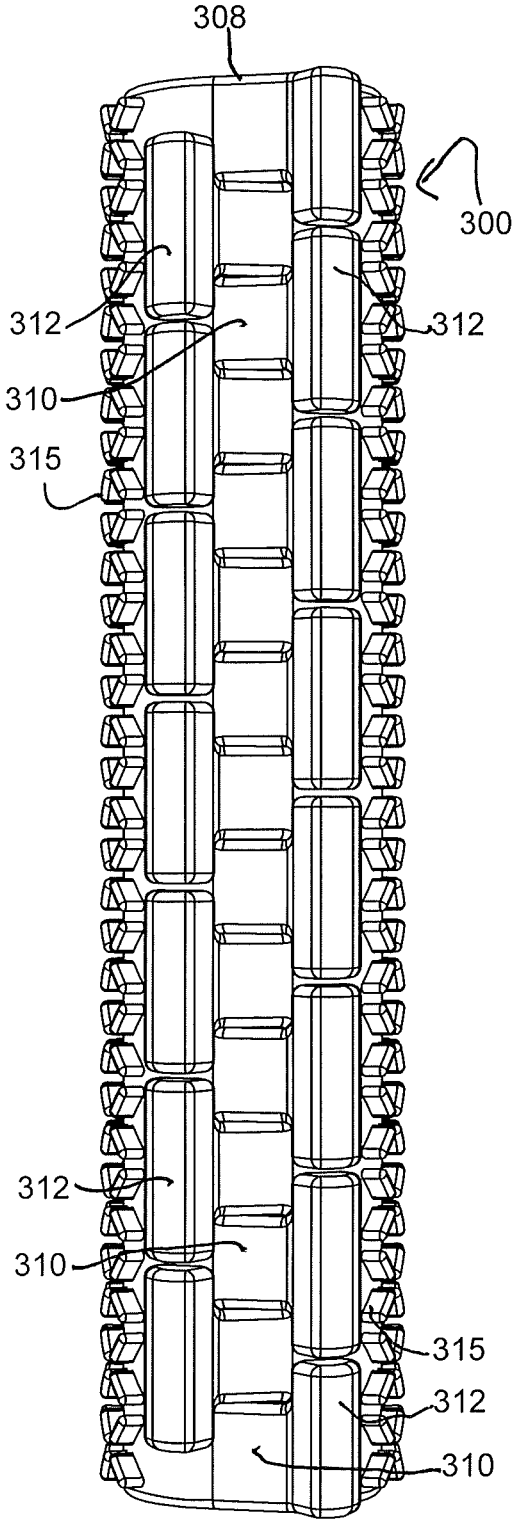
Figure 16:
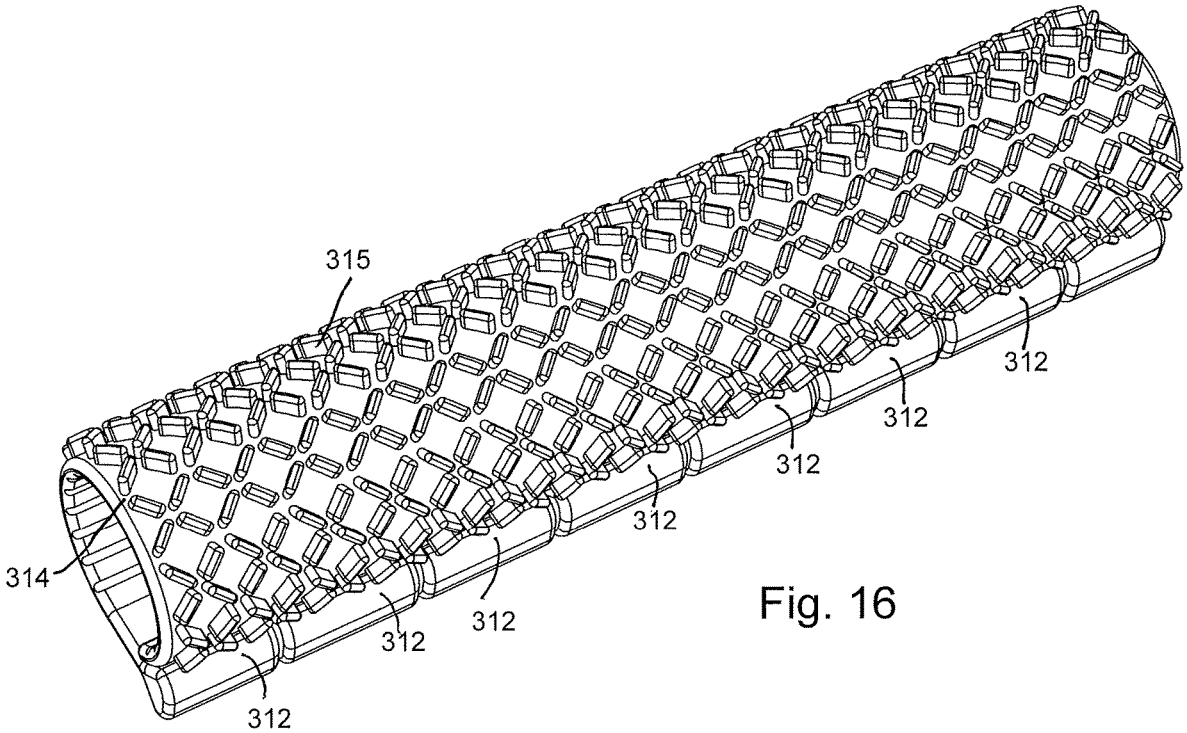
FIG. 16 is a perspective view of the embodiment of FIG. 15.
Figure 17A:
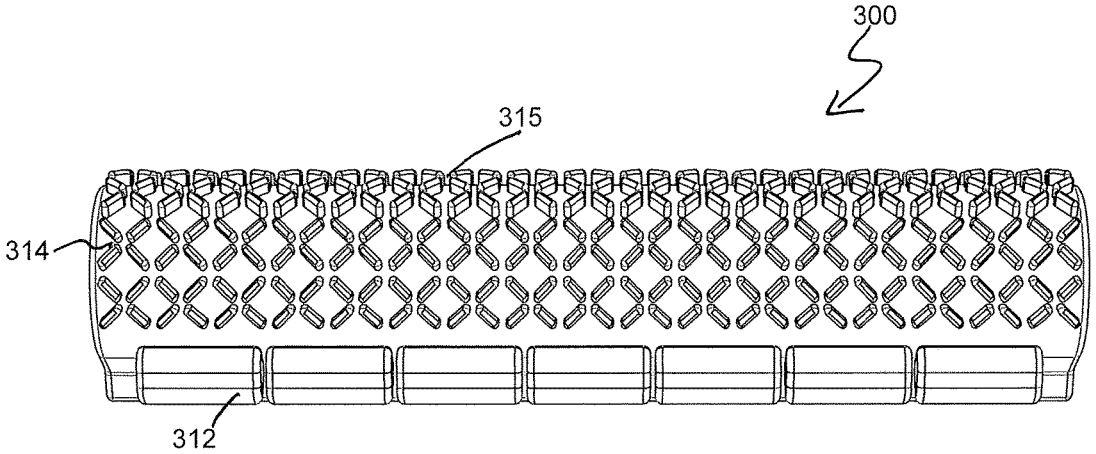
FIGS. 17(*a*) and 17(*b*) are first and second side views of the embodiment of FIG. 15.
Figure 17B:
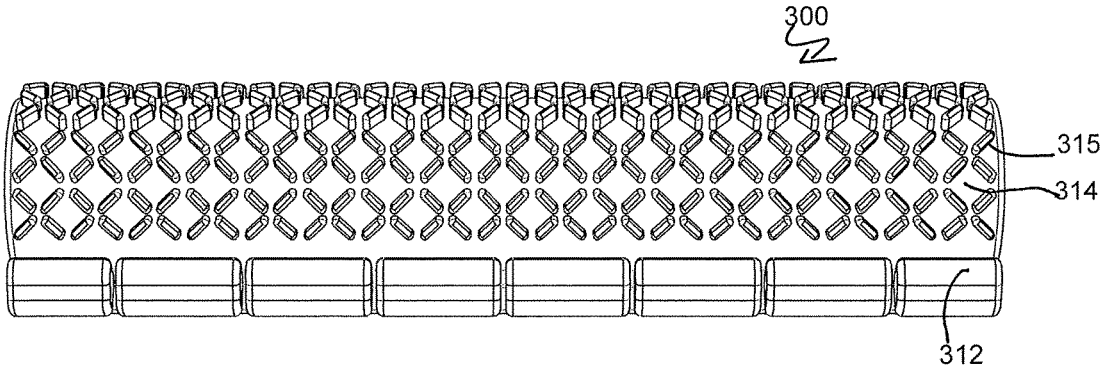
Figure 18:
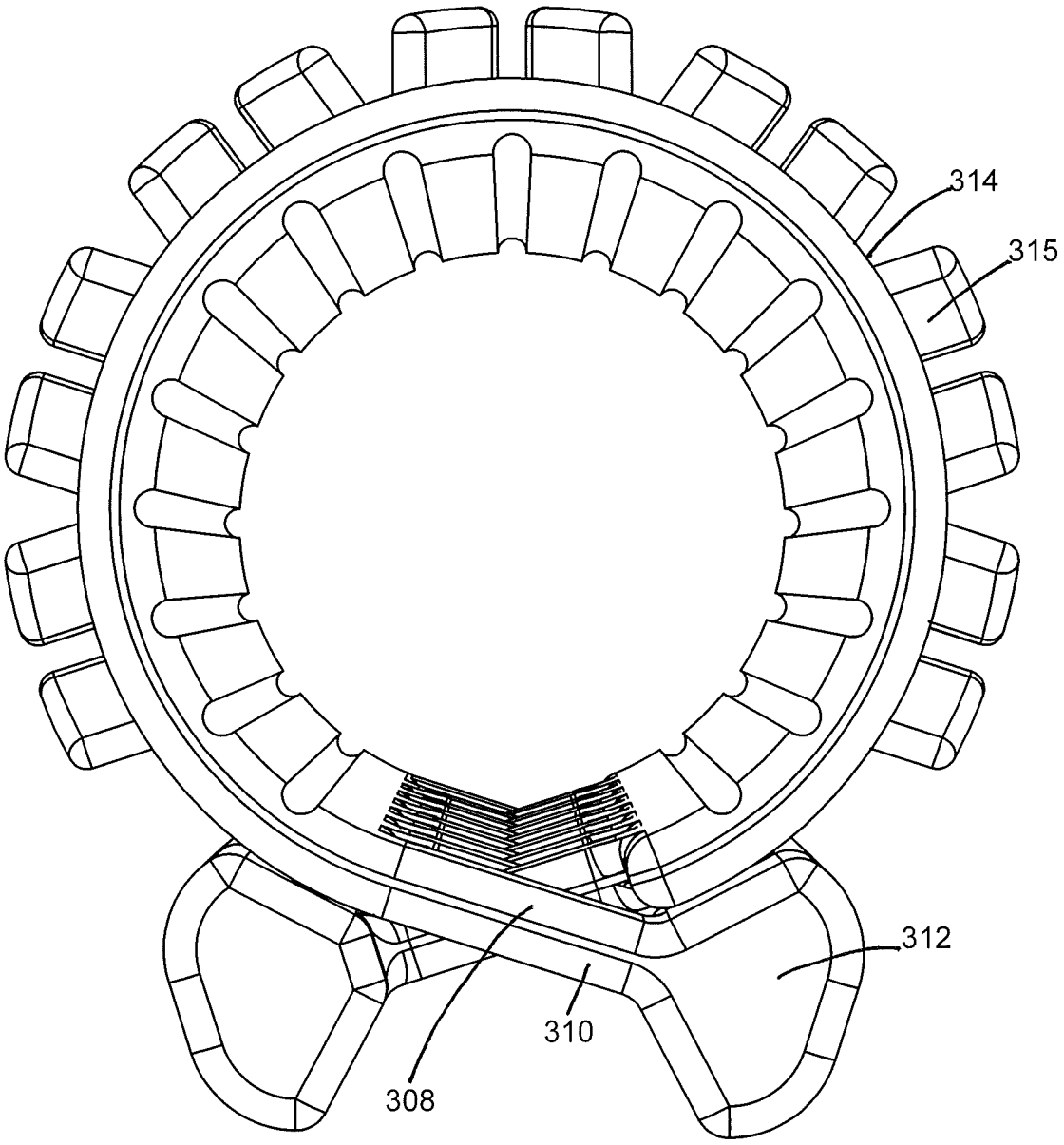
FIG. 18 is an end view of the embodiment of FIG. 15.

In order to provide a frictional surface on which the towel rests, towel contacting surface 314 of device 300 may further include a plurality of raised members 315 or include another type of texturing. In one embodiment, as shown in FIG. 10(*a*), towel contacting surface 314 may include a plurality of dimples on the surface. FIG. 11 and FIGS. 12-13 show differently shaped members, such as upstanding squares or diagonally distributed raised surfaces, as shown in FIGS. 15-18. The embodiments of FIGS. 10-18 are preferably made of a polymeric material having sufficient elasticity such that the device 300 can be stretched over a towel holder 22. In one embodiment, as noted above, a preferred material may be silicone or other polymer, including silicone rubber elastomer. The device may be molded.

Figures 19, 20:
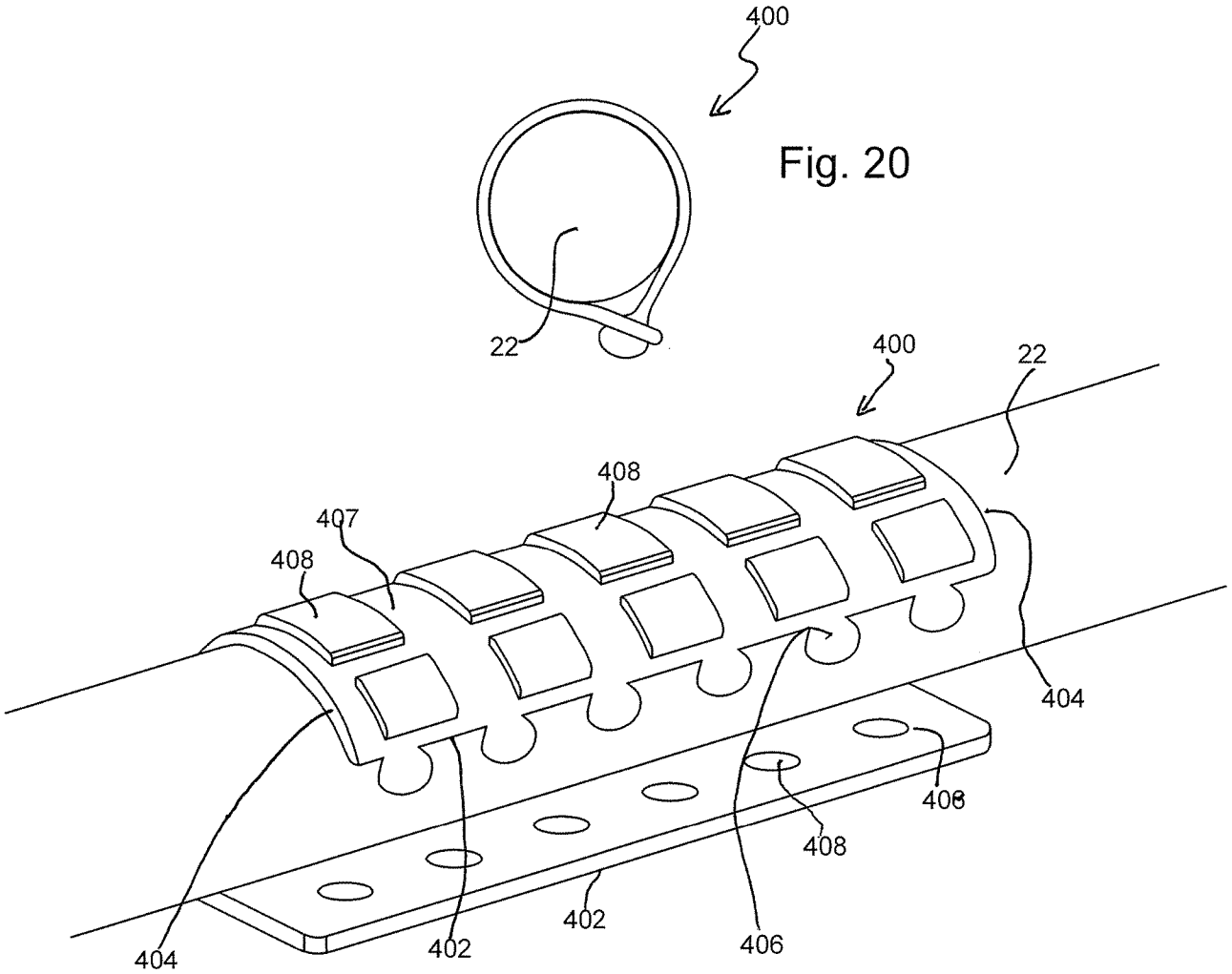
FIG. 19 is a perspective view of another embodiment of a device made in accordance with the present disclosure in the disengaged condition.
FIG. 20 is an end view of the embodiment of FIG. 19 in an engaged condition.

A further alternative embodiment of a device in accordance with the present disclosure is shown in FIGS. 19-20. As with the embodiment described above, e.g., device 300, device 400 may likewise be provided in the form of a sheet that can be stretched and applied over a towel holder 22. As with the previous embodiment, device 400 may be a sheet that is rectangularly shaped having ends 402 and sides 404. Ends 402 or sides 404 may terminate in a plurality of ball fingers that extend from the respective ends or sides. On the opposite end or side, device 400 may include a series of notches 408 configured to receive ball fingers 406 and provide a locking engagement between ends 402 or sides 404. As with the previously described embodiments, device 400 may also include a top surface 407 that includes frictional members such as dimples or raised surfaces, as shown in FIGS. 19-20. As noted, device 400 is preferably made of a polymeric or other material with sufficient elasticity that it can be stretched over towel holder 22 of variable diameters or shapes. Preferably, the material is silicone or other polymer, including silicone rubber elastomer. The device may be molded.

Figure 22:
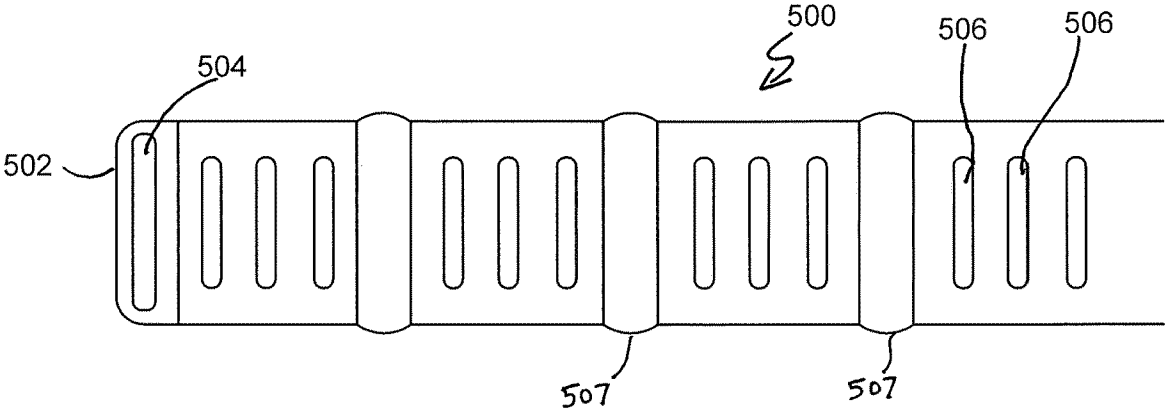
FIG. 22 is a partial top view of the embodiment of FIG. 21 in the disengaged condition.
Figure 23:
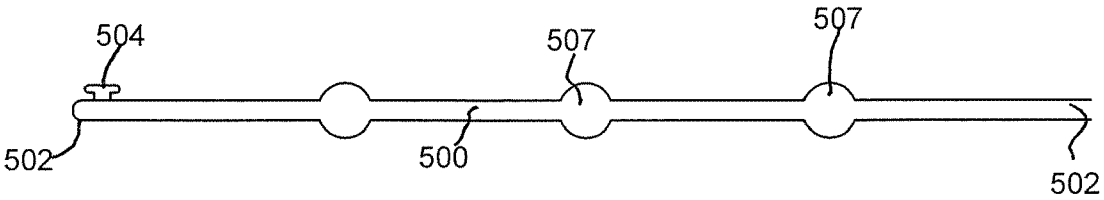
FIG. 23 is a side view of the embodiment of FIG. 22.
Figure 21:
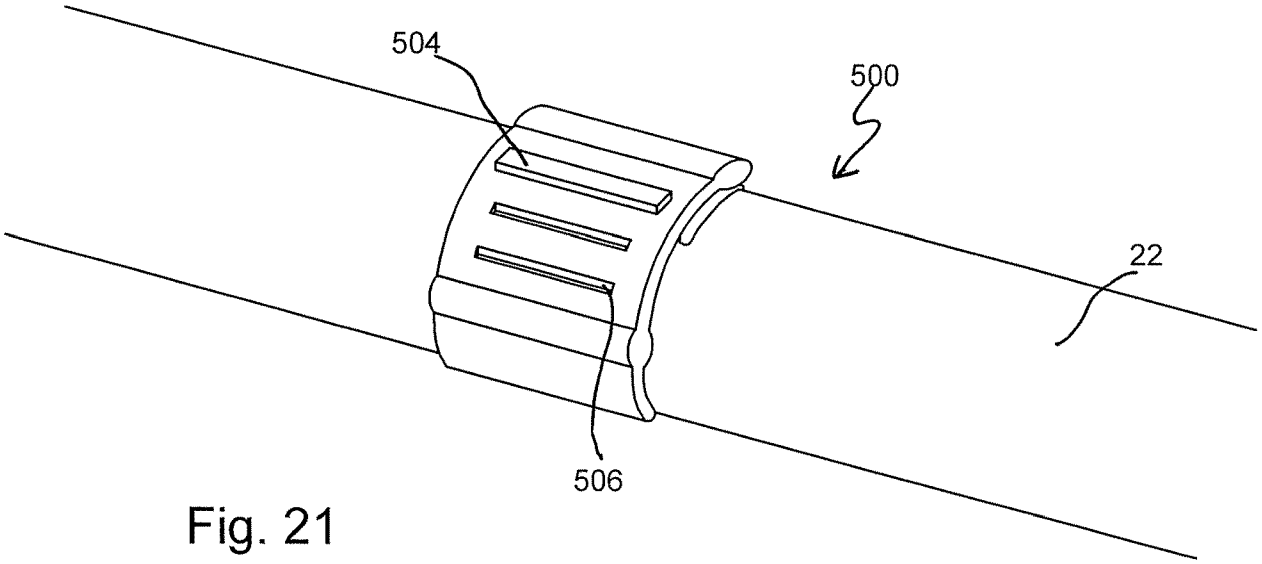
FIG. 21 is a perspective view of another embodiment of a device made in accordance with the present disclosure in the engaged condition.

Yet another embodiment of a device made in accordance with the present disclosure is shown in FIGS. 21-23. Device 500 provides an adjustable strap or sheet including first and second ends 502. Strap or sheet of device 500 may include a hook or other fastener 504 which is configured to engage a mating slot 506 on the sheet or strap. A plurality of slots 506 may be provided in the strap or sheet of device 506 to accommodate towel holders 22 of different diameters or shapes. Device 500 may further include raised surfaces 507 spaced along the length of strap or sheet of device 500 to allow for frictional contact between the device 500 and a towel as well as between device 500 and a towel holder 22.

Figure 24:
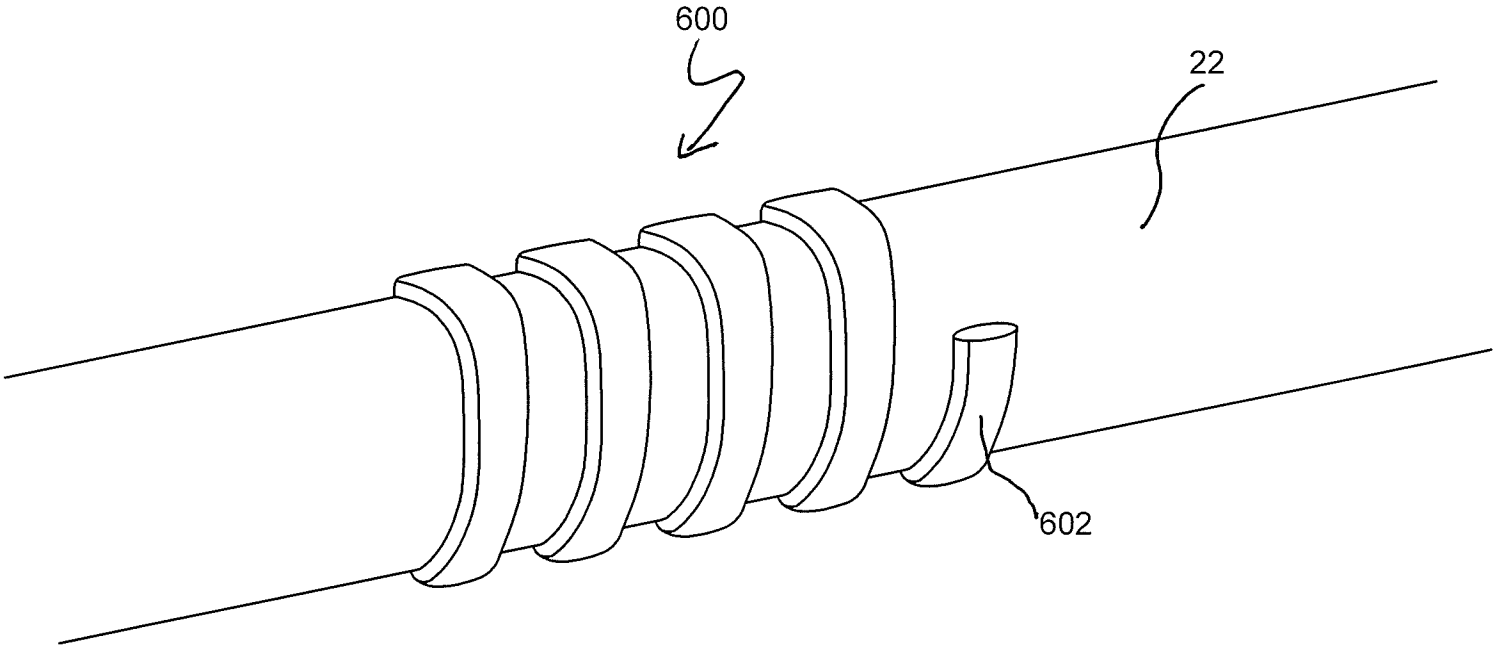
FIG. 24 is a perspective view of still another embodiment of a device made in accordance with the present disclosure in the engaged condition.
Figure 25:
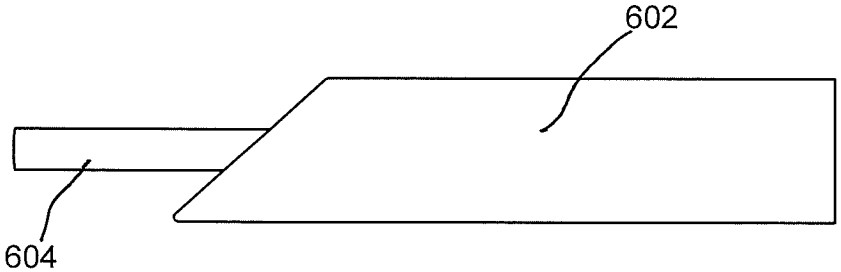
FIG. 25 is a partial side view of the embodiment of FIG. 24.

A further alternative embodiment of a device in accordance with the present disclosure is shown in FIGS. 24-25. As shown in FIG. 24, device 600 may be in the form of an elongated strip 602, which is configured and adapted to be wrapped around in a spiral or coiled fashion over a towel holder 22. Strip 602 is preferably made of a polymeric material such as, but not limited to, silicone. In addition, strip 602 may include an internal member, such as a metal wire, embedded within the interior of strip 602 to provide device 600 with a degree of rigidity. Wire 604 or other member may be over molded with the selected polymeric material (e.g., silicone or polymer/elastomer).

Figure 28:
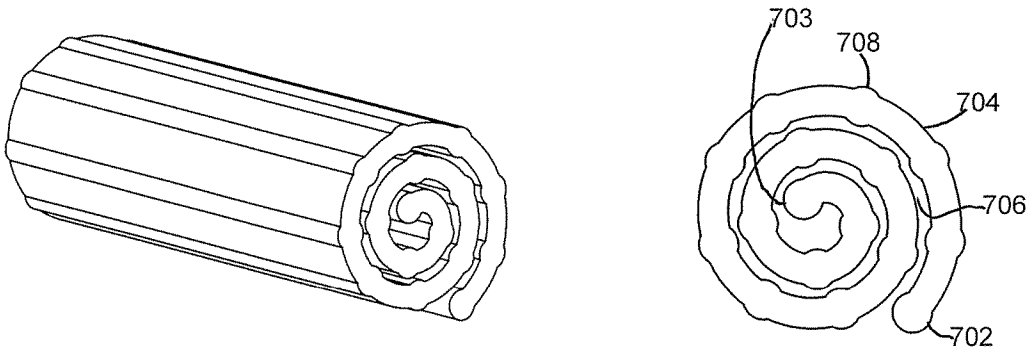
FIG. 28 is an end view of the embodiment of FIG. 26 in its spiral-wound condition.
Figure 26:
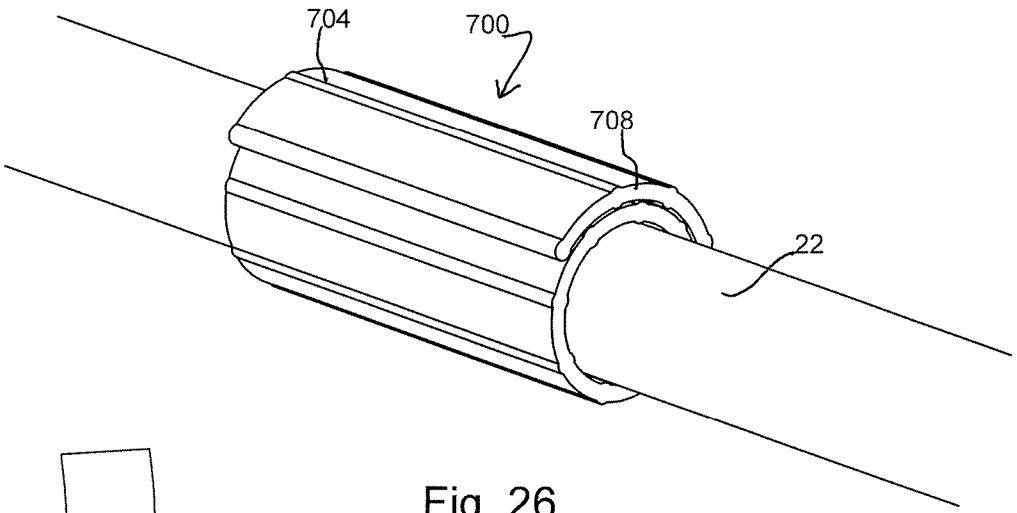
FIG. 26 is a perspective view of still further embodiment of a device made in accordance with the present disclosure in its spiral and engaged condition on a towel holder.
Figure 27:
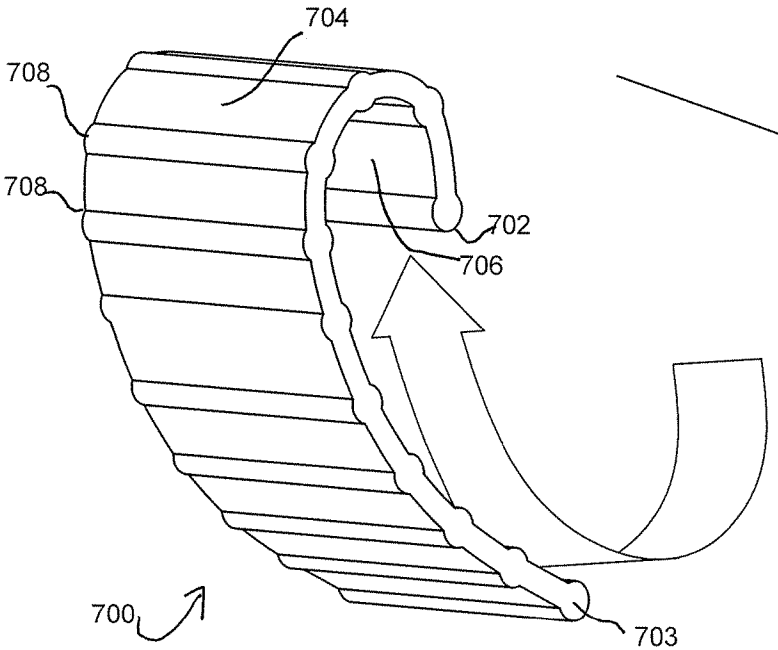
FIG. 27 is a perspective view of the embodiment of FIG. 26 in its unraveled condition.

A further embodiment of a device made in accordance with the present disclosure is shown in FIGS. 26-28. As shown in FIGS. 26-28, device 700 maybe, again, a strip or sheet having first and second ends 702 and 703, respectively. Device 700 may be rolled over towel holder 22 and itself successively, as shown in FIG. 26. Device 700 may be maintained in a rolled up spiral fashion, as shown in FIG. 28, for easy storage and may be easily unrolled or unraveled as required. Device 700 includes top surface 704 and bottom surface 706. One or both of top or bottom surfaces 704 and 706 may include ridges 708 or be otherwise contoured to enhance frictional engagement of device 700 with a towel and/or a towel holder.

FIGS. 29-30(*a*) and 30(*b*) show a further embodiment of a device made in accordance with the present disclosure. The device of FIG. 29 includes a first end 802 and second end 803, which can likewise be placed, mounted, and/or stretched over a towel holder 22. As shown in FIG. 29, outer surface of device 800 may be dimpled, contoured, or otherwise textured to provide a frictional surface for a towel. Ends 802 and 803 may be brought together in a locking engagement by clasp 806. As with the previous embodiments, any suitable polymeric or plastic material may be used in device 800. In one embodiment, the preferred material may be silicone. Device 800 may be molded.

Figure 32:
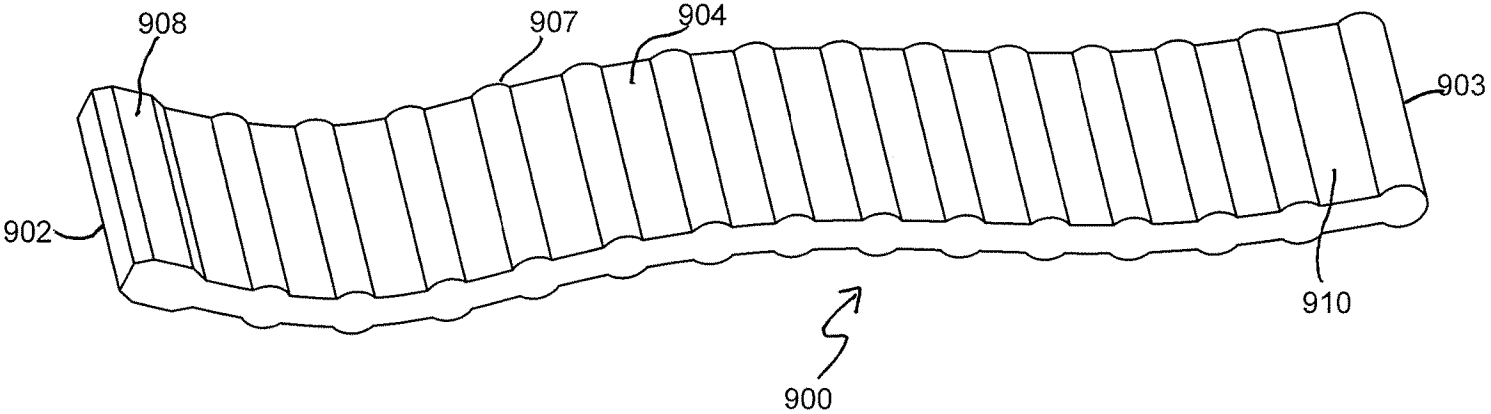
FIG. 32 is a perspective view of the embodiment of FIG. 31 in its unraveled condition.
Figure 33:
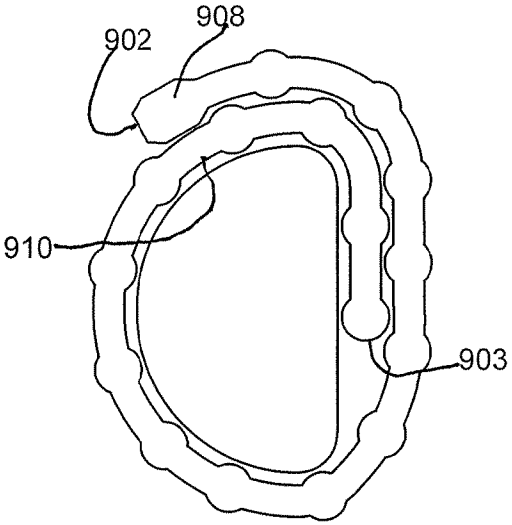
FIG. 33 is an end view of the embodiment of FIG. 31 mounted on a towel holder.
Figure 31:
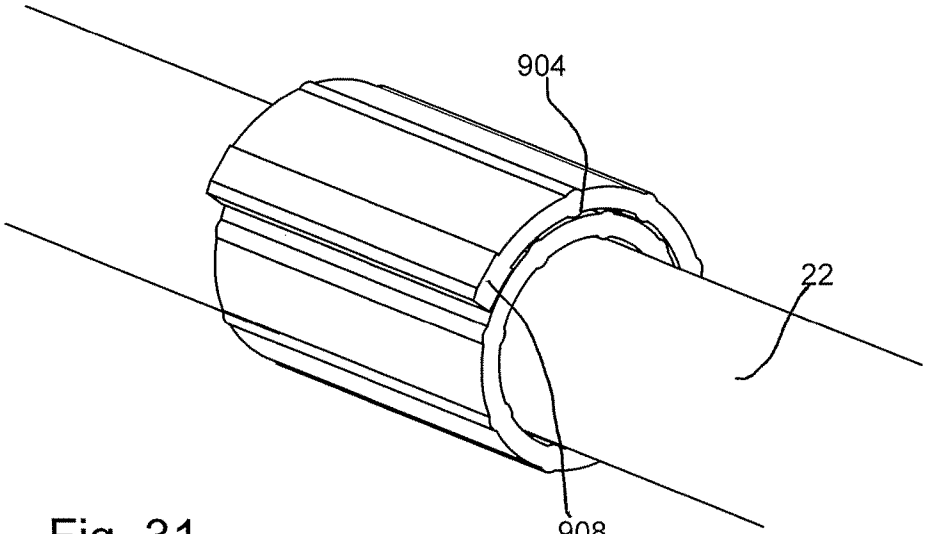
FIG. 31 is a perspective view of another embodiment of a device in accordance with the present disclosure.

A still further variation or embodiment of a device made in accordance with the present disclosure is shown in FIGS. 31-33. Similar to the embodiments described above (device 700), device 900 may be a strip or sheet of material having a first end 902 and a second end 903. Top surface 904 and/or bottom surface 905 may include ridges or other raised surfaces 907 to provide friction for placement of a towel and/or placement onto a towel holder. At least one of ends 902 or 903 may further include a magnet 908 on the surface 904 or embedded within device 900. At the end opposite the end that includes the magnet, device may be embedded with one or more metal pieces 910. Device 900 may be wrapped around towel holder 22 and, optionally, itself and retained in place by the magnetic attraction between magnet 908 and embedded metal 910, as shown for example in FIG. 33. Device 900 may be made of any suitable polymeric or plastic material. In one embodiment, silicone polymer/elastomer may be preferred. Metal piece 910 and/or magnet 908 may be overmolded by the polymeric material, e.g., silicone.

Figure 34:
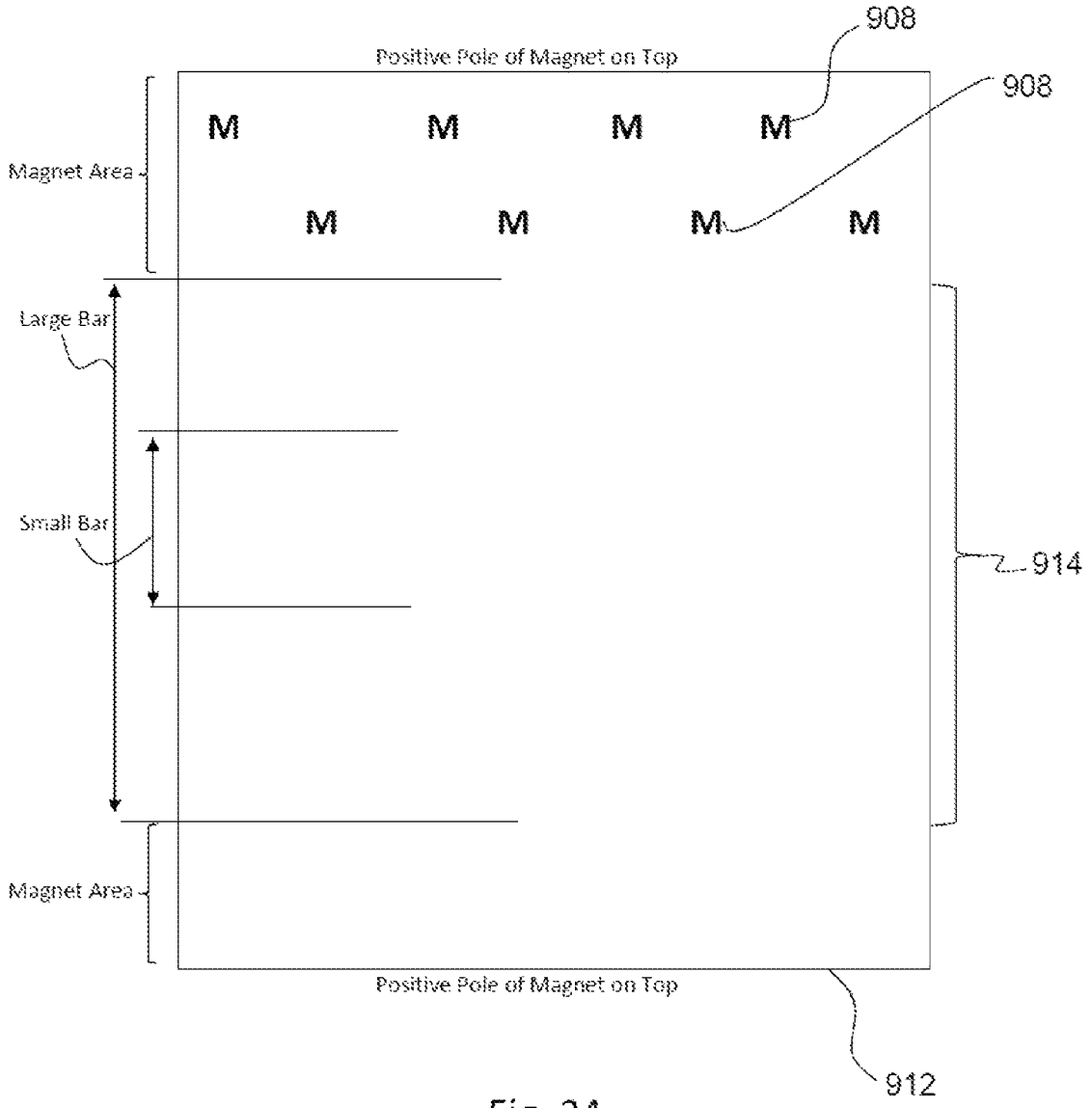
FIG. 34 is a top view of a variation of the embodiment of FIG. 32 in an unraveled condition.
Figure 35:
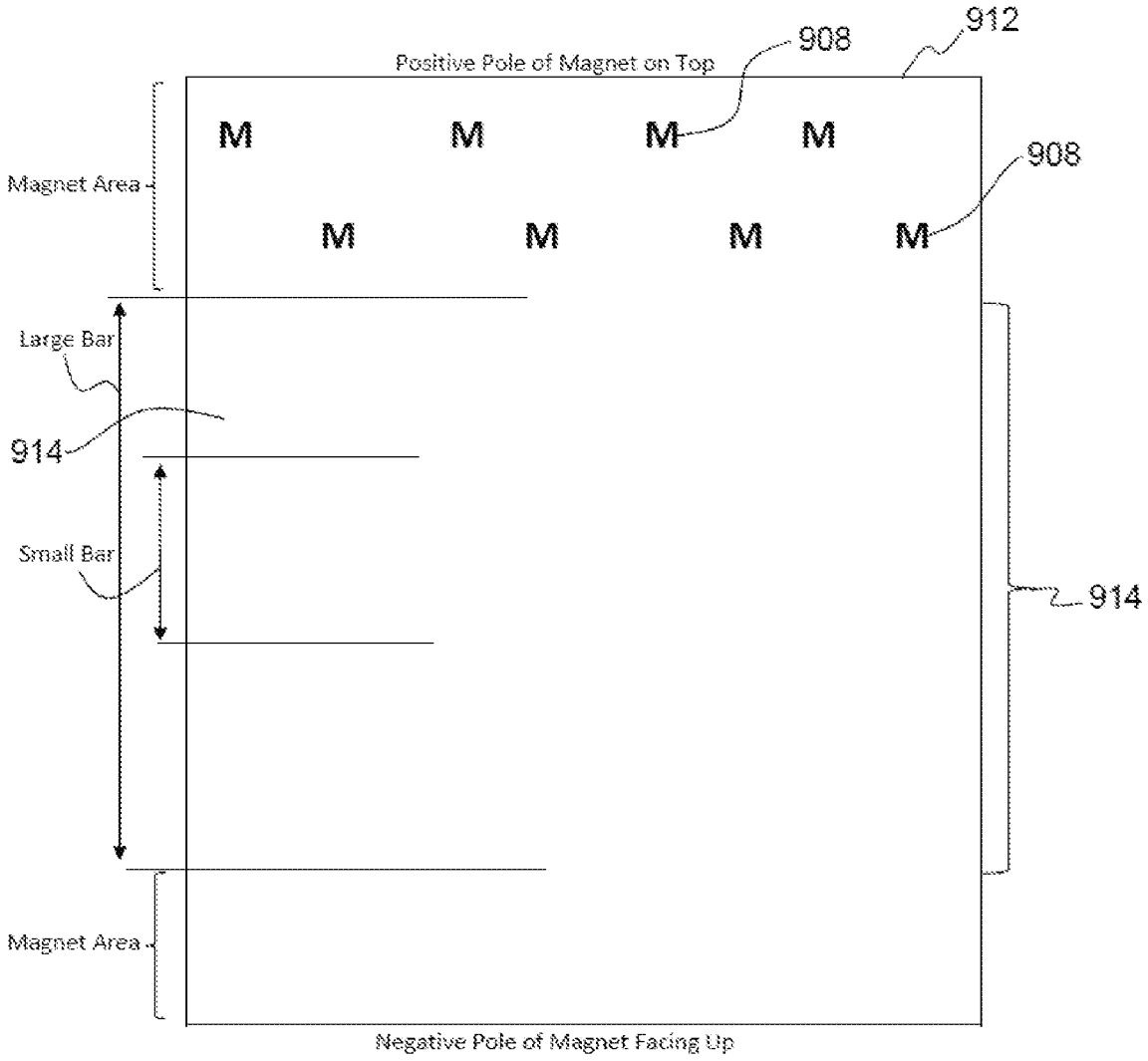
FIG. 35 is a top view of a further variation of the embodiment of FIG. 3 in an unraveled condition.
Figure 36A:
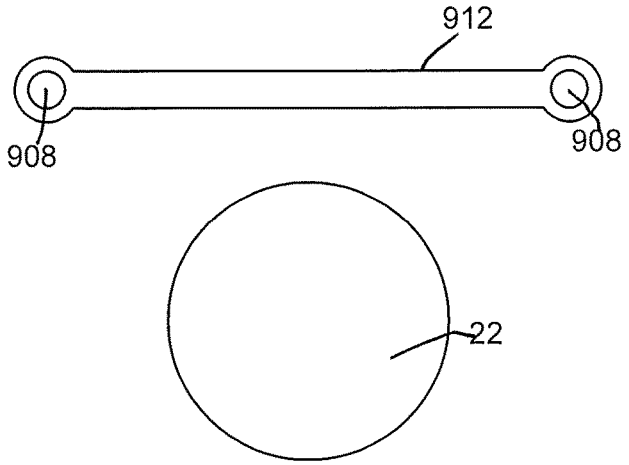
FIG. 36(*a*)-36(*c*) is a series of end views depicting the mounting of a variation of the embodiment of FIG. 35 onto a towel holder.
Figure 36B:
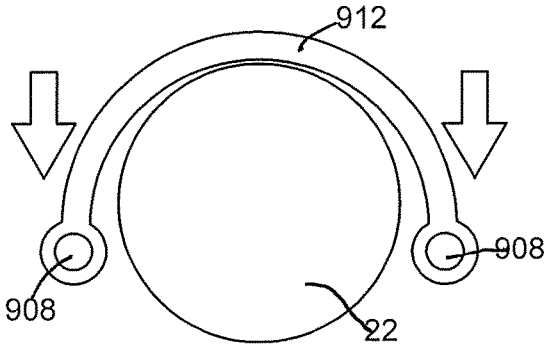
Figure 36C:
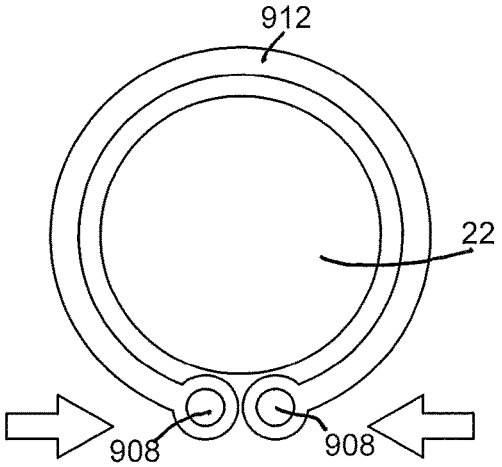

In a further variation of the magnetic attachment in device 900, device may be provided as a sheet 912, shown in FIGS. 34 and 35. Sheet 912 may resemble the sheet shown in FIG. 3 described above and in International Patent Application Publication WO 2014/189951, the entire contents of which is incorporated herein by reference. In either case, sheet 912 may include one or more magnets 908 at one end of sheet 910. The opposed end of sheet 910 may likewise include embedded magnets or metal pieces to provide for attachment of one end of the sheet to the other end, either as a spirally wrapped sheet or a U-shaped sheet attached with facing plies (see FIG. 3) attached to each other (by magnetic force). A central portion 914 of sheet 912 may be at least substantially or completely devoid of magnets. In a variation of this embodiment, sheet 912 may preferably be made of a plastic or polymeric material with some degree of elasticity such that sheet 912 can be stretched over towel holder 22 and secured at its ends by embedded magnets 908, as shown generally in FIGS. 36(*a*) through 36(*c*).

Figure 38:
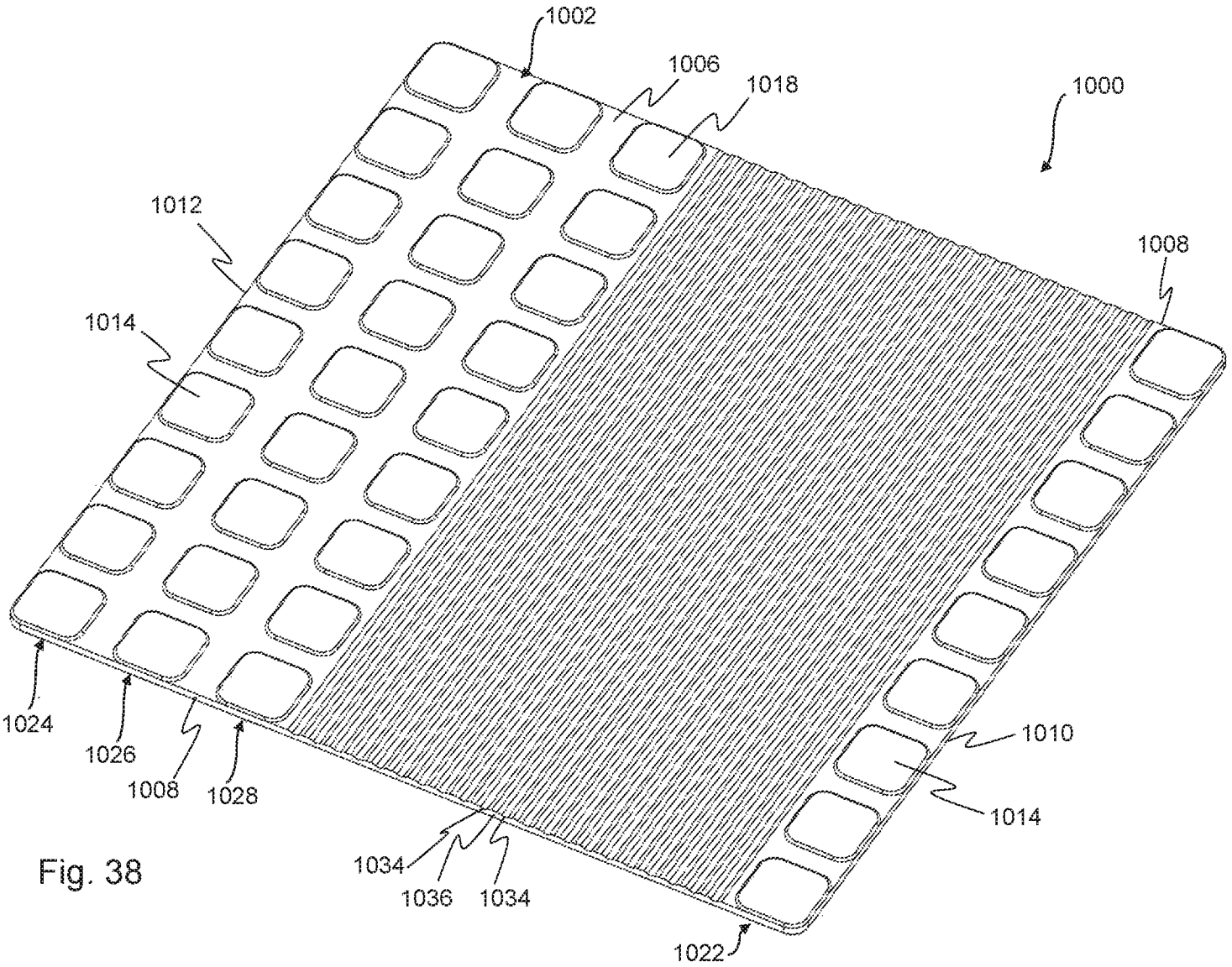
FIG. 38 is a bottom perspective view of the embodiment of FIG. 37 in an unraveled condition.
Figure 39:
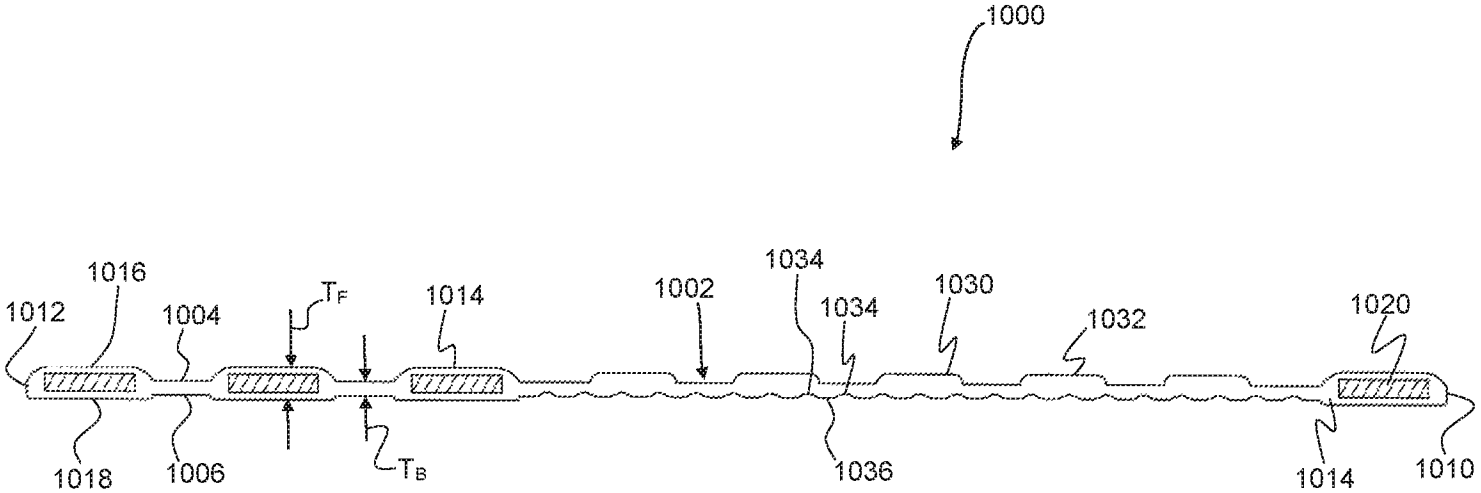
FIG. 39 is a cross-sectional view of the embodiment of FIG. 37, taken through the line 39-39 of FIG. 37.
Figure 40:
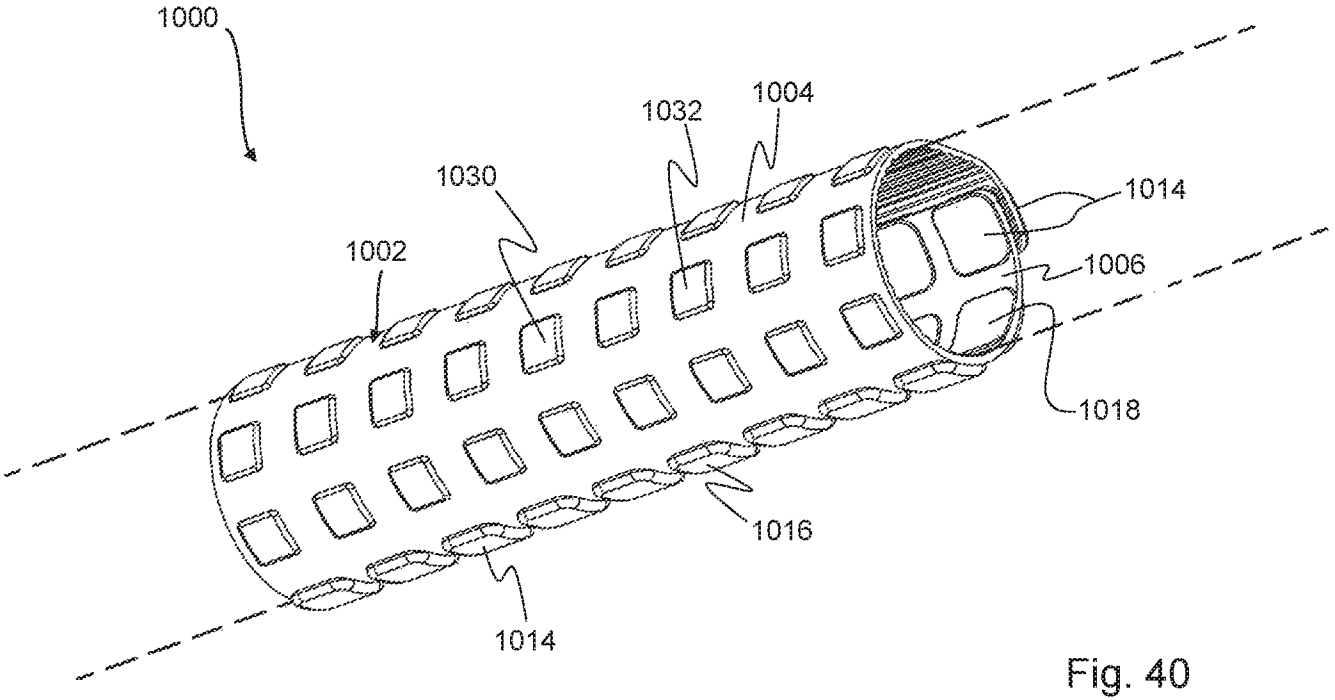
FIG. 40 is a perspective view of the embodiment of FIG. 37 in an engaged condition.
Figure 41:
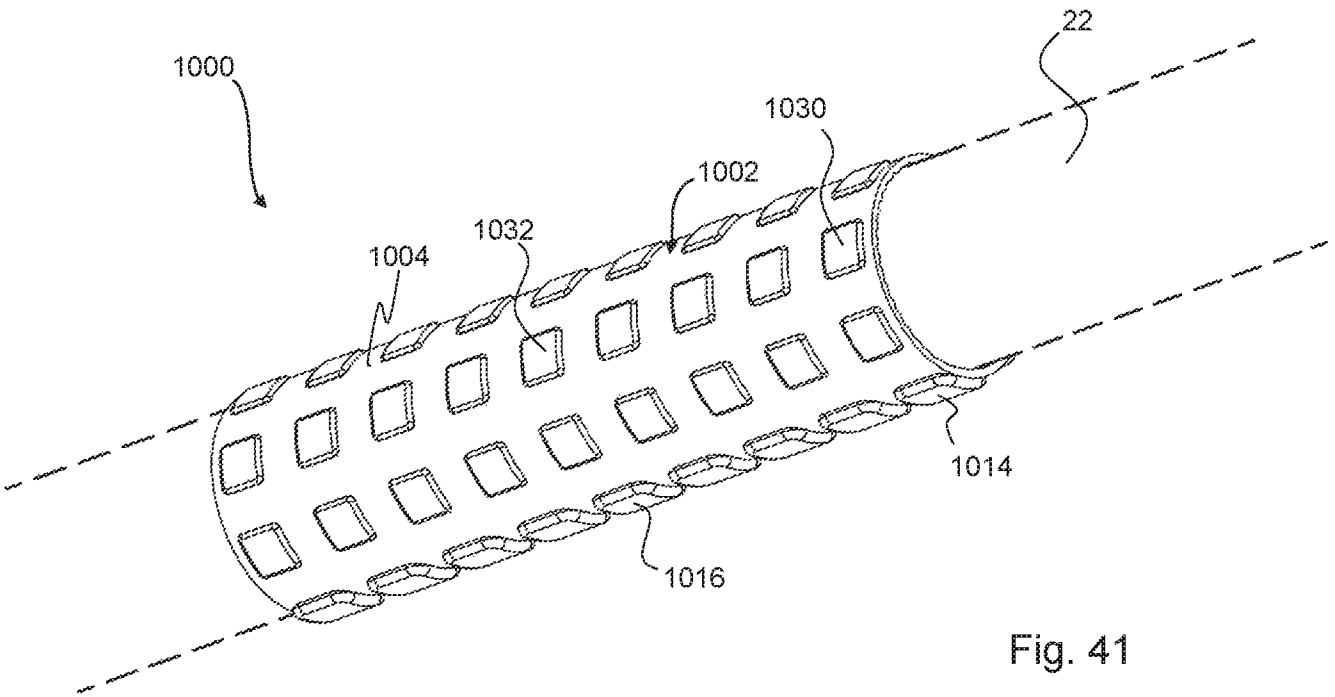
FIG. 41 is a perspective view of the embodiment of FIG. 37 mounted on a towel holder.
Figure 42:
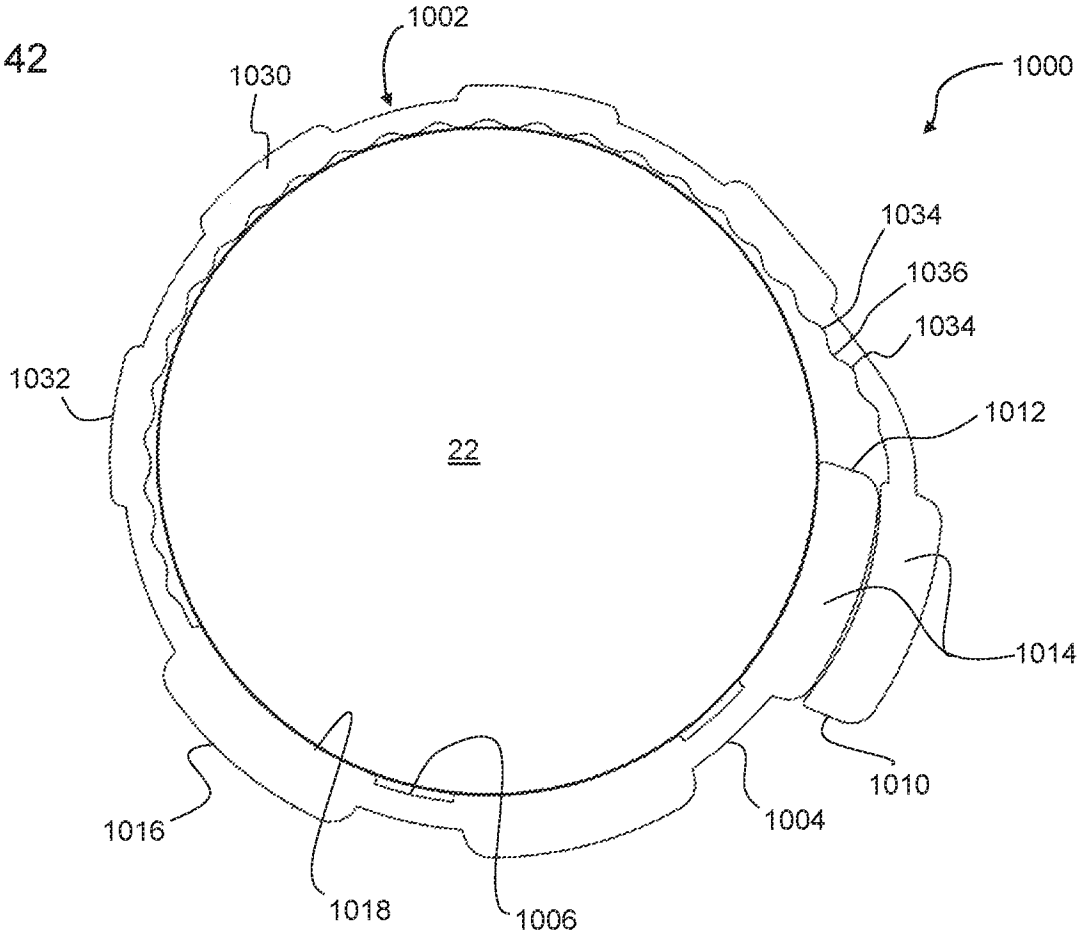
FIG. 42 is an end view of the embodiment of FIG. 37 mounted on a towel holder.

FIGS. 37-42 illustrate yet another embodiment of a towel holding device 1000 with a body 1002 defining a towel contacting surface 1004 and an opposed towel holder contacting surface 1006, in accordance with an aspect of the present disclosure. The device 1000 may be provided as a sheet (FIGS. 37-39) formed of a material that is sufficiently flexible so as to take on a less planar (e.g., generally tubular) shape when wrapped around and mounted to a towel holder 22 (FIGS. 40-42). In addition to being adapted for wrapping, the device 1000 may be made of resilient material having a sufficient degree of elasticity such that it can be stretched, if necessary, and used with towel holders of different diameters and different shapes. As with the previous embodiments, the resilient material may be or include silicone or other polymer, including silicone rubber elastomer.

Figure 37:
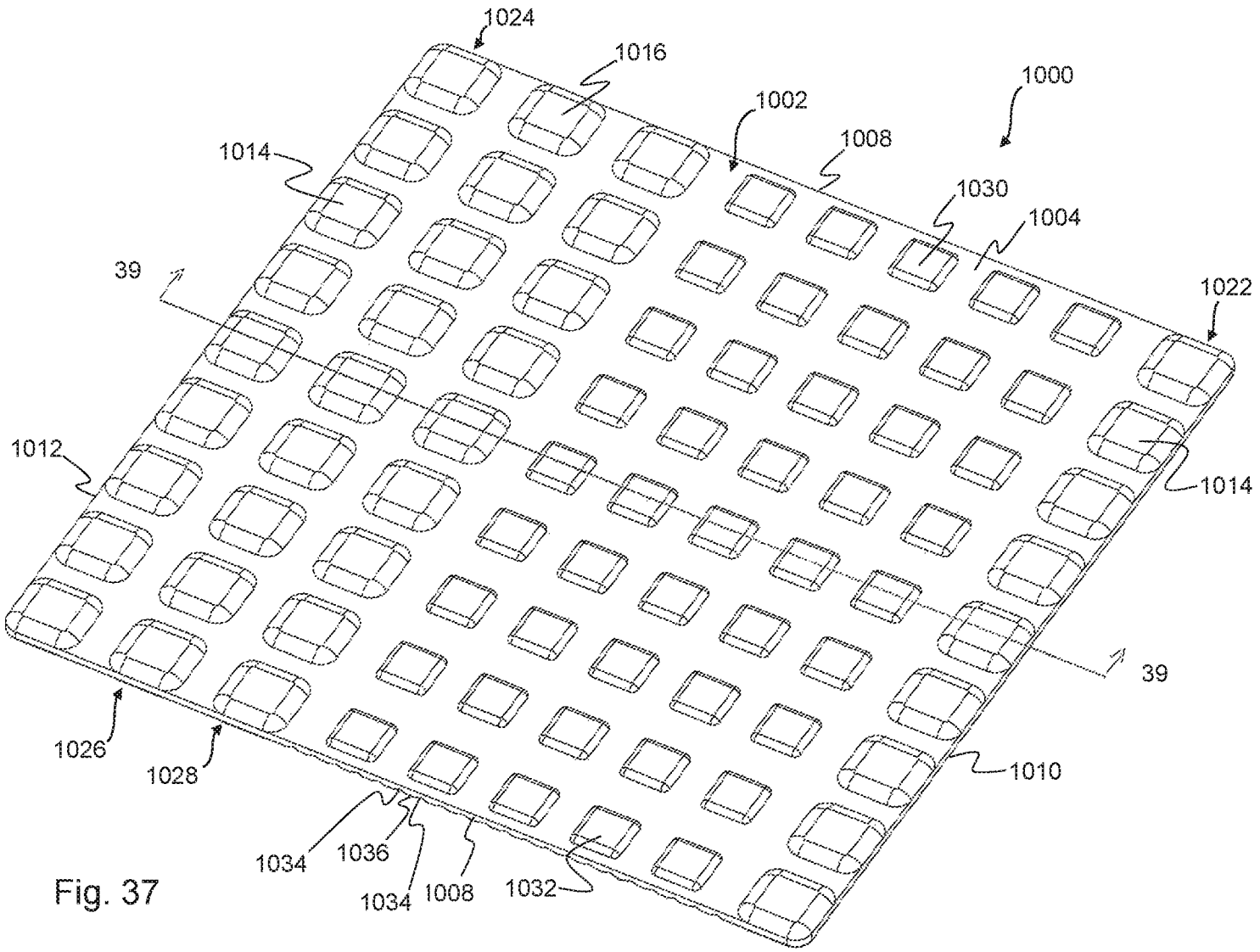
FIG. 37 is a top perspective view of another embodiment of a device in accordance with the present disclosure in an unraveled condition.

As shown in FIGS. 37-39, the device 1000, in its unapplied and unraveled condition may be substantially rectangular, having opposing ends 1008 and opposing first and second edges 1010 and 1012. Other shapes (e.g., a generally oval shape) are also possible without departing from the scope of the present disclosure. Either the ends 1008 or the edges 1010 and 1012 may be configured for engagement with the opposed respective ends or edges. For example, as shown in FIGS. 37-39, the device 1000 may have a generally planar body 1002 with a plurality of raised or enlarged attachment formations 1014, with at least one positioned adjacent to each of the edges 1010 and 1012 and having a greater thickness $T_F$ than the thickness $T_B$ of the body 1002 (FIG. 39). If an edge 1010, 1012 has only one attachment formation, it may be advantageous for the single attachment formation to be relatively elongated, such as extending along all or a substantial portion of the width of the associated edge 1010, 1012 to create greater surface area for attachment. Such elongated attachment formations may also be employed for an edge 1010, 1012 having a plurality of attachment formations associated therewith.

In the illustrated embodiment, the attachment formations 1014 are substantially identical, with each being generally configured as a truncated square pyramid or a square frustum with rounded edges and corners. In other embodiments, the attachment formations 1014 may have different shapes (e.g., all being generally circular) and/or sizes (in terms of the area occupied by each attachment formation 1014 and/or the thickness $T_F$ of each attachment formation 1014). For example, rather than nine generally square attachment formations 1014 extending along the width of the edges 1010 and 1012, a single rectangular attachment formation may extend along the width of the edges 1010 and 1012 or three rectangular attachment formations (individually having greater surface areas than the surface areas of the individual illustrated attachment formations 1014) may be arranged in a row along the width of an edge 1010, 1012. Regardless of the shape of the attachment formations 1014, as will be described in greater detail, the attachment formations 1014 function to connect the edges 1010 and 1012 of the device 1000 together by association with a mating attachment formation 1014, such that it may be advantageous for all of the attachment formations 1014 to be substantially identically configured.

Each attachment formation 1014 is shown as extending beyond both the towel contacting surface 1004 and the towel holder contacting surface 1006, with a greater extension above the towel contacting surface 1004 than below the towel holder contacting surface 1006. In other embodiments, an attachment formation 1014 may extend to an equal degree above the towel contacting surface 1004 and below the towel holder contacting surface 1006 or extend farther below the towel holder contacting surface 1006 than above the towel contacting surface 1004. While the degree of these extensions may vary between the attachment formations 1014 of an individual device 1000, it may be advantageous for all of the attachment formations 1014 to be substantially identically configured for improved connection of the edges 1010 and 1012 of the device 1000, as will be described in greater detail.

Each attachment formation 1014 is further shown as having a substantially flat upper and lower surface 1016 and 1018, which are parallel with each other and with the plane defined by the body 1002 of the device 1000. In other embodiments, one or both of the upper and lower surfaces 1016 and 1018 of one or more of the attachment formations 1014 may be non-planar and/or inclined with respect to the plane defined by the body 1002, but it may be advantageous for all of the upper and lower surfaces 1016 and 1018 of the attachment formations 1014 to be substantially parallel with each other and the plane defined by the body 1002 for improved connection of the edges 1010 and 1012 of the device 1000, as will be described in greater detail.

The flexible device 1000 may be deformed from its flat, unraveled condition of FIGS. 37-39 to a less planar (e.g., tubular), engaged condition, such as the one shown in FIGS. 40-42. In the engaged condition, the upper surface 1016 of at least one attachment formation 1014 positioned adjacent to the first end 1010 is aligned with and connected to the lower surface 1018 of at least one attachment formation 1014 positioned adjacent to the second edge 1012 (as best shown in FIG. 42), thereby retaining the device 1000 in its engaged condition. Alternatively, rather than the upper surface 1016 of the attachment formation 1014 of each aligned pair being connected to the lower surface 1018 of the other attachment formation 1014 of the pair, the lower surfaces 1018 of each pair of aligned attachment formations 1014 may be connected, resulting in an engaged condition as shown in FIGS. 1-3, rather than a tubular arrangement. In either case, there is preferably a secure, yet easily disengaged connection between the aligned and connected attachment formations 1014, such that the device 1000 may be moved between the unraveled and engaged conditions at will.

In one embodiment, a magnet 1020 (FIG. 39) is associated with (and more preferably embedded within) each of the attachment formations 1014, such that the aligned attachment formations 1014 are held together by magnetic attraction. In such an embodiment, the enlarged attachment formations 1014 allow for larger magnets 1020, while providing sufficient support material surrounding the magnets 1020 to prevent material failure and detachment of the magnets 1020 from the remainder of the device 1000. Furthermore, additional support material surrounding the magnets 1020 may help to shield the magnets 1020 from heat emanating from an oven or the like adjacent to the towel holder 22. If provided, the magnets 1020 may be embedded within the attachment formations 1014 by any suitable manufacturing procedure, including an overmolding process or a layering processing by which the magnets 1020 are sandwiched between two layers of flexible material defining the remainder of the device 1000.

Additionally, the orientation of the magnets 1020 may depend upon the intended use of the device 1000. For example, if the device 1000 is intended to be used in a way that two or more attachment formations 1014 are aligned and connected at their lower surfaces 1018 (resulting in the "U-shaped" configuration of FIGS. 1-3), then the magnets 1020 associated with one of the edges 1010, 1012 may be flipped over compared to the orientation of the magnets 1020 when the lower surface 1018 of at least one attachment formation 1014 is connected to the upper surface 1016 of another attachment formation 1014, as in the illustrated embodiment. This ensures proper polarity, such that the magnets 1020 of a pair of attachment formations 1014 attract, rather than repel. In yet another embodiment, one edge 1010, 1012 may have at least two magnets 1020 (which may comprise two rows of magnets 1020) that are oppositely oriented, with their polarities reversed. This would allow for a magnet 1020 associated with the opposite edge 1010, 1012 to be connected to a magnet 1020 having a particular polarity to place the device 1000 in the "U-shaped" configuration of FIGS. 1-3 or to an oppositely oriented magnet 1020 to place the device 1000 in the tubular configuration of FIGS. 40-42.

While the incorporation of magnets 1020 into the attachment formations 1014 may be preferred, in other embodiments, other means may be provided for connecting pairs of attachment formations 1014, such as a (preferably weak) adhesive or interlocking members (e.g., an extension of one attachment formation 1014 that is received within a cavity of a matching attachment formation 1014).

In the illustrated embodiment, one row 1022 of attachment formations 1014 adjacent to the first edge 1010 is aligned with and connected to another row 1024 of attachment formations 1014 adjacent to the second edge 1012 in the engaged condition. While it is not necessary for the attachment formations 1014 to be provided in uniform rows and columns (as in the illustrated embodiment), it may be advantageous for the attachment formations 1014 to be arranged in some regular distribution pattern to simplify alignment and connection of pairs of attachment formations 1014.

If the attachment formations 1014 are provided in rows, it may be advantageous for the first edge 1010 include one row 1022 of attachment formations 1014 and the second edge 1012 to include a plurality of rows 1024, 1026, and 1028. In such an embodiment, the single row 1022 of attachment formations 1014 may be aligned with and connected to one of the rows 1024, 1026, 1028 of attachment formations 1014 adjacent to the second edge 1012, depending on the diameter of the associated towel holder 22. In other embodiments, each edge 1010, 1012 may include a single row of attachment formations 1014 or a plurality of rows of attachment formations 1014, with each edge 1010, 1012 having the same or a different number of associated rows of attachment formations 1014.

In order to provide a frictional surface on which the towel rests, the towel contacting surface 1004 of the device 1000 may further include a plurality of raised or enlarged friction members or formations 1030 or include another type of texturing. In the illustrated embodiment, the friction formations 1030 are positioned between the attachment formation (s) 1014 associated with the first edge 1010 and the attachment formation(s) 1014 associated with the second edge 1012. The friction formations 1030 may be integrally formed with the body 1002 of the device 1000, preferably made of a polymeric material (which is silicone, in one embodiment) having sufficient flexibility and elasticity such that the device 1000 can be stretched over a towel holder 22.

Similar to the attachment formations 1014, the friction formations 1030 extend above the towel contacting surface 1004 of the body 1002, but unlike the attachment formations 1014, they do not also extend beyond the towel holder contacting surface 1006 in the illustrated embodiment. In the illustrated embodiment, the friction formations 1030 are substantially identical to each other, with the same general shape as the attachment formations 1014 (i.e., each being generally configured as a truncated square pyramid or a square frustum with rounded edges and corners) and with the same height as each other. In other embodiments, the friction formations 1030 may have different shapes (e.g., all being generally circular) and/or sizes (in terms of the area occupied by each friction formation 1030 and/or the height of each friction formation 1030). In the illustrated embodiment, the friction formations 1030 are to be smaller than the attachment formations 1014, both in terms of height and surface area, but it is also within the scope of the present disclosure for one or more of the friction formations 1030 to have a greater height and/or to have a greater surface area than one or more of the attachment formations 1014.

Each friction formation 1030 is further shown as having a substantially flat upper surface 1032, which is parallel with the plane defined by the body 1002 of the device 1000. In other embodiments, the upper surface 1032 of one or more of the friction formations 1030 may be non-planar and/or inclined with respect to the plane defined by the body 1002, although it may be advantageous for all of the friction formations 1030 to be substantially identically configured to provide the towel with a more uniform contact interface.

Similar to the attachment formations 1014, the friction formations 1030 may be arranged in uniform rows and columns. In the illustrated embodiment, there are the same number of columns of attachment formations 1014 and friction formations 1030 (nine) and different numbers of rows of attachment formations 1014 (four) and friction formations 1030 (five). In other embodiments, the attachment formations 1014 and friction formations 1030 may be provided in different numbers of rows and columns.

As described previously and best seen in FIG. 39, the illustrated friction formations 1030 extend above the towel contacting surface 1004 without extending beyond the towel holder contacting surface 1006. Instead, the portion of the towel holder contacting surface 1006 corresponding to the portion of the towel contacting surface 1004 occupied by the friction formations 1030 may include a plurality of grooves 1034 defined in the body 1002 of the device 1000. In the illustrated embodiment, the grooves 1034 are substantially parallel to each other and to the edges 1010 and 1012 of the body 1002, extending between the ends 1008 of the body 1002. This orientation of the grooves 1034 may be advantageous because the grooves 1034 effectively define pivot points (by representing the omission or absence of material of the body 1002), which may allow for easier deformation of the device 1000 from its unraveled condition to the engaged condition as the ridges 1036 defined between adjacent grooves 1034 are folded toward each other. Additionally, the grooves 1034 create friction to allow the device

1000 to better adhere to the associated towel holder 22, thereby preventing the device 1000 from rotating about the towel holder 22. In other embodiments, the region occupied by the grooves 1034 in the illustrated embodiment may be differently configured, such as with raised panels (preferably extending no farther below the towel holder contacting surface 1006 than the attachment formations 1014) arranged in a grid pattern for a different friction profile than that provided by the grooves 1034.

It will be understood that the embodiments and examples described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A device for preventing a towel from slipping off of a towel holder, said device configured to be removable from said towel holder and comprising;

a flexible, generally planar body comprising a sheet including a pair of opposing first and second edges and defining a towel contacting surface configured to provide a frictional interface for a towel, and an opposed towel holder contacting surface configured to contact a towel holder;

a plurality of first attachment formations associated with the sheet and positioned adjacent to the first edge of the sheet, said first attachment formations extending at least from and above said towel contacting surface;

and a plurality of second attachment formations associated with the sheet and positioned adjacent to the second edge of the sheet, said second attachment formations extending at least from and above said towel contacting surface wherein each of the first and second attachment formations has a greater thickness than the sheet, wherein a portion of said sheet between the first attachment formations positioned adjacent to the first edge of the body and the second attachment formations positioned adjacent to the second edge of the body is at least substantially devoid of attachment formations;

wherein said portion of said sheet that is devoid of said attachment formations comprises a plurality of friction formations associated and integral with said body and extending above the towel contacting surface; and wherein said first and second attachment formations include embedded magnets and said friction formations are free of magnets;

wherein each attachment formation of the first and second attachment formations includes an upper surface positioned above the towel contacting surface, each of the first and second attachment formations includes a lower surface positioned below the towel holder contacting surface, and wherein the upper surface of the first attachment formations positioned adjacent to the first edge of the sheet is configured to be aligned with and connected to the lower surface of the second attachment formations positioned adjacent to the second edge of the sheet in order to magnetically secure the body around the towel holder in an overlapping manner; or the upper surface of the second attachment formations positioned adjacent to the second edge of the sheet is configured to be aligned with and connected to the lower surface of the first attachment formations positioned adjacent to the first edge of the sheet in order to magnetically secure the body around the towel holder in an overlapping manner.

2. The device of claim 1, wherein the first attachment formations positioned adjacent to the first edge of the sheet are arranged in a row, and the second attachment formations positioned adjacent to the second edge of the body are arranged in a plurality of rows.

3. The device of claim 1, wherein the first and second attachment formations are substantially identical.

4. The device of claim 1, wherein each of the first and second attachment formations is generally configured as a square frustum with rounded edges and corners.

5. The device of claim 1, wherein the upper and lower surfaces of the first and second attachment formations are substantially parallel with a plane defined by the body of the device.

6. The device of claim 1, wherein the upper surfaces of the first and second attachment formations are positioned farther above the towel contacting surface than the lower surfaces of the first and second attachment formations are positioned below the towel holder contacting surface.

7. The device of claim 1, wherein the sheet is formed of a polymeric material.

8. The device of claim 1, wherein the sheet is formed of a silicone material.

9. The device of claim 1, wherein the plurality of friction formations are substantially identical.

10. The device of claim 1, wherein each friction formation has the same general shape as each attachment formation of the first and second attachment formations.

11. The device of claim 1, wherein each friction formation has an upper surface positioned above the towel contacting surface, and wherein the upper surfaces of the friction formations are closer to the towel contacting surface than the upper surfaces of the first and second attachment formations.

12. The device of claim 1, wherein the plurality of friction formations are arranged in uniform rows and columns.

13. The device of claim 1, further comprising a plurality of grooves defined in the towel holder contacting surface, wherein the plurality of grooves are positioned between the first attachment formations positioned adjacent to the first edge and the second attachment formations positioned adjacent to the second edge, and the plurality of grooves extend substantially parallel to the first and second edges.

14. The device of claim 1, wherein said friction formations do not extend below the towel holder contacting surface.

15. The device of claim 1, wherein the body is generally rectangular.

* * * * *